US011691303B2

(12) United States Patent
Stapelbroek et al.

(10) Patent No.: US 11,691,303 B2
(45) Date of Patent: Jul. 4, 2023

(54) STATIONARY BLADE, BLADE SET, AND HAIR CUTTING APPLIANCE

(71) Applicant: KONINKLIJKE PHILIPS N.V., Eindhoven (NL)

(72) Inventors: Martinus Bernardus Stapelbroek, Eindhoven (NL); Jan Bennik, Eindhoven (NL); John Pragt, Eindhoven (NL); Remy Amos Abraham Ripandelli, Eindhoven (NL); Robbert Freerk Johan Van Der Scheer, Eindhoven (NL); Jan Van Dalen, Eindhoven (NL); Albert Jan Aitink, Eindhoven (NL); Roland Van Straaten, Eindhoven (NL); Everhardus Johannes Hoexum, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 97 days.

(21) Appl. No.: 15/548,600

(22) PCT Filed: Feb. 11, 2016

(86) PCT No.: PCT/EP2016/052930
§ 371 (c)(1),
(2) Date: Aug. 3, 2017

(87) PCT Pub. No.: WO2016/134979
PCT Pub. Date: Sep. 1, 2016

(65) Prior Publication Data

US 2018/0009121 A1 Jan. 11, 2018

(30) Foreign Application Priority Data

Feb. 25, 2015 (EP) ..... 15156626

(51) Int. Cl.
*B26B 19/38* (2006.01)
*B26B 19/06* (2006.01)

(52) U.S. Cl.
CPC ..... *B26B 19/3846* (2013.01); *B26B 19/063* (2013.01); *B26B 19/3893* (2013.01)

(58) Field of Classification Search
CPC ..... B26B 19/063; B26B 19/3846; B26B 19/3893; B26B 19/06; B26B 19/38
(Continued)

(56) References Cited

U.S. PATENT DOCUMENTS 2,102,529 A 12/1937 Hanley
2,151,965 A 3/1939 Hanley
(Continued)

FOREIGN PATENT DOCUMENTS

DE 2026509 A1 12/1970
EP 2857156 A1 4/2015
WO 2013150412 A1 10/2013

*Primary Examiner* — Nhat Chieu Q Do

(57) ABSTRACT

A hair cutting appliance includes a stationary blade having a first wall portion arranged to serve as a skin facing wall when in operation; and a second wall portion offset from the first wall portion such that the first and second wall portions a guide slot that receives a movable cutter blade. A toothed leading edge is jointly formed by the first and second wall portions. Teeth at the toothed leading edge include a first leg defined by the first wall portion, and a second leg defined by the second wall portion. The first and second wall portions are connected at a frontal end of the toothed leading edge, thereby forming tips of the teeth. The second legs of the teeth are tapered along a portion of their longitudinal extension towards a bottom side of the stationary blade facing away from the skin, when in operation.

15 Claims, 11 Drawing Sheets

(58) Field of Classification Search
USPC ..... 30/43
See application file for complete search history.

(56) References Cited

U.S. PATENT DOCUMENTS 2,290,326 A * 7/1942 Hanley ..... B26B 19/38
30/223
2,948,063 A * 8/1960 Jepson ..... B26B 19/042
30/34.1
2018/0009121 A1 1/2018 Stapelbroek

* cited by examiner

STATIONARY BLADE, BLADE SET, AND HAIR CUTTING APPLIANCE

This application is the U.S. National Phase application under 35 U.S.C. § 371 of International Application No. PCT/EP2016/052930, filed on Feb. 11, 2016, which claims the benefit of International Application No. 15156626.2 filed on Feb. 25, 2015. These applications are hereby incorporated by reference herein.

FIELD OF THE INVENTION

The present disclosure relates to a hair cutting appliance, particularly to an electrically operated hair cutting appliance, and more particularly to a stationary blade for a blade set for such an appliance. The blade set may be arranged to be moved through hair in a moving direction to cut hair. The stationary blade may comprise a first wall portion and a second wall portion that define therebetween a guide slot, where a movable cutter blade may be at least partially encompassed and guided. More particularly, the present disclosure further relates to advantageous designs of cutting teeth of such a stationary blade.

BACKGROUND OF THE INVENTION

U.S. Pat. No. 2,102,529 A discloses a hair clipping apparatus comprising a plate having parallel faces and a beveled margin, serrations across said margin, the wider face of said plate being undercut in registry with said serrations, an outer and thinner sheet metal shear plate straddling said beveled margin and slots transversely of said straddling edge, closed at both ends and determining shearing edges co-acting with the portions of the serrations exposed at said beveled margin. At the top of the outer shear plate, a latch plate is provided.

U.S. Pat. No. 2,151,965 A discloses a similar arrangement including a blade set for a hair clipper.

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

EP 2 857 156 A1 which has been published only after the priority date of the present disclosure relates to a similar arrangement of a blade set.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that prevents hair from being cut off close to the skin. Consequently, a user desiring to both shave and trim his/her body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles some of these issues by providing a blade set comprising a stationary blade that houses the movable blade such that a first portion of the stationary blade is arranged at the side of the movable blade facing the skin, when used for shaving, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows longer hairs to enter the slots and, consequently, to be cut off by the relative cutting motion between the movable blade and the stationary blade.

However, there is still a need for improvement in hair cutting appliances and respective blade sets. This may particularly involve user comfort related aspects, performance related aspects, and manufacturing related aspects. Manufacturing related aspects may involve suitability for series production or mass production, and may involve design features that are enabled by novel manufacturing and/or material approaches for the formation of blade sets as described herein.

SUMMARY OF THE INVENTION

It is an object of the present disclosure to provide an alternative stationary blade, and a corresponding blade set that enable both shaving and trimming operations. In particular, a stationary blade and a blade set may be provided that contribute to a pleasant user experience in both shaving and trimming operations. More preferably, the present disclosure may address at least some drawbacks inherent in known prior art hair cutting appliance and blade sets as discussed above. It would be further advantageous to provide for a blade set and a stationary blade that may exhibit an improved operating performance while, at the same time, preferably reducing the time required for cutting operations. It is further preferred to provide for a stationary blade, and for a hair cutting appliance that is fitted with a respective blade set, that are particularly suited for catching and cutting relatively long hairs, particularly flat-lying hair and/or unkempt and/or shaggy hair.

In a first aspect of the present disclosure a stationary blade for a blade set of a hair cutting appliance is presented, said blade set being arranged to be moved through hair in a moving direction to cut hair, said stationary blade comprising:

- a first wall portion arranged to serve as a skin facing wall when in operation;
- a second wall portion at least partially offset from the first wall portion, such that the first wall portion and the second wall portion define therebetween a guide slot arranged to receive a movable cutter blade;
- at least one toothed leading edge jointly formed by the first wall portion and the second wall portion;

wherein a plurality of teeth is provided at the at least one toothed leading edge, the teeth comprising a first leg defined by the first wall portion and a second leg defined by the second wall portion;

wherein the first wall portion and the second wall portion are connected at a frontal end of the at least one toothed leading edge, thereby forming tips of the teeth; and wherein the teeth are, at their second legs, tapered along at least a substantial portion of their longitudinal extension towards a bottom side of the stationary blade facing away from the skin, when in operation, in such a way that that the second legs and the first legs are arranged in a non-symmetrical fashion with respect to one another.

This aspect is based on the insight that the design of the stationary blade including the first wall portion and the second wall portion that—so-to-say—cover and guard the movable cutter blade that may be received in the guide slot therebetween, on the one hand side, may significantly increase the rigidity and strength of the blade set. This may have a positive impact on the cutting performance, particularly the shaving performance when the blade set directly contacts the user's skin to cut hair at the level of the skin. However, on the other hand, the stationary blade also shows a considerable performance in trimming operations and/or in shaving operations where relative long hair is removed. Particularly, long hairs that are not arranged at a basically right angle with respect to the skin surface may cause difficulties in catching and guiding the hairs to the movable cutter blade.

Typically, the hairs have to be caught and guided into teeth slots that are arranged between and alternating with teeth of the stationary blade. In the teeth slots between the teeth of the stationary blade, the teeth of the movable cutter blade can be moved, preferably in a reciprocating fashion. As a consequence, whenever a hair enters the teeth slots properly, a respective cutting operation may be accomplished due to the relative cutting motion between the movable cutter blade and the stationary blade of the blade set. Consequently, the hair may be cut or chopped between respective (basically longitudinally extending) cutting edges of the teeth of the stationary blade and the teeth of the movable cutter blade.

Since the stationary blade comprises a first wall portion and a second wall portion that define the guide slot for the movable cutter blade, the overall height of the blade set in the region of the toothed cutting edges is larger than a respective overall height of prior art blade sets that utilize stationary blades that implement only a single wall portion that is arranged between the movable cutter blade and the to-be-processed skin, when in operation. As a consequence of the increased height, account should be taken of the hair-catching capability with respect to relatively flat-lying hair and/or unkempt hair. Assuming that some hairs (hair filaments) are arranged at a relatively small angle with respect to the skin surface when contacted by the toothed leading edge of the stationary blade, it may not be unlikely that, due to their flat orientation, at least some of the hairs may not enter the respective tooth slots or slot spaces between the teeth but rather are bent away by the stationary blade which—so to say—runs flat hairs over. This may prolong the time required for the cutting operation and diminish the cutting performance. It is therefore desired to form the second legs of the teeth of the stationary blade (i.e. those legs that are facing away from the skin, when in operation, in such a way that they do not (or merely to a limited extent) interfere with basically flat-lying hairs. As a consequence, also flat hairs may enter the tooth slots and, as a consequence, be removed by the hair cutting appliance.

The increased height of the stationary blade, at the leading edges thereof, is insofar desired as the stationary blade may be further reinforced in this way. Since the second wall portion is arranged on the side of the movable cutter blade that is not directly involved in the cutting operation, such an arrangement does not impede the blade set's capability of cutting hair very close to the skin in a shaving operation. Further, since the second wall portion provides the stationary blade with sufficient rigidity, the thickness or height of the first wall portion may be even further reduced so as to further improve the shaving performance.

So as to maintain the desired stiffness of the stationary blade, an overall height of the teeth thereof is preferably maintained. Hence, simply reducing the thickness or height of the second wall portion so as to improve the blade set's capability of catching and processing longer hairs that are oriented in a flat fashion is therefore not desirable.

As used herein, the stationary blade may be also referred to as guard or guard blade. It is preferred that, with respect to an outline of the stationary blade in the region of the toothed cutting edges, the movable cutter blade, particularly the teeth thereof does not protrude beyond the respective outline of the stationary blade. As a consequence, skin injuries, skin irritations and/or skin cuts which may be caused by direct contact of the skin and the movable cutter blade may be significantly reduced.

In accordance with at least some embodiments of the present disclosure, the stationary blade is manufactured in such a way that, in terms of their longitudinal cross section (i.e. their cross section perpendicular to the longitudinal direction), the first wall portion and the second wall portion may be differently shaped. The first wall portion forms the first leg of the teeth. The first leg of the teeth in each case is used for the cutting operation and therefore provided with respective cutting edges at longitudinally extending lateral sides thereof. The cutting edges of the first leg of the teeth may cooperate with corresponding cutting edges of respective teeth of the movable cutter blade, when in operation. So as to facilitate the hair cutting operation, a respective lateral extension (width of the first legs) may also define a maximum overall lateral extension of the teeth of the stationary blade.

In other words, compared to the width of the first legs in the vicinity of the cutting edges thereof, the second legs may be at least sectionally significantly smaller in width. So as to facilitate catching and cutting hairs that are arranged in a considerably flat fashion with respect to the skin, the second legs are preferably tapered towards the bottom side, i.e. the side of the stationary blade that is opposite to the skin-facing side. In other words, an allowed or open space which may be entered by the hairs without colliding with the teeth may be increased in this way even though the lateral extension (width) of the first legs is not reduced. When viewed in a longitudinal side view, a respective cross section of the teeth of the stationary blade typically exhibits a profile section of the second leg that runs or extends from the guide slot towards the bottom side in a pinnacling fashion. As used herein, a tapering may also include a narrowing, a trapezoid-like geometry, a triangular geometry and/or a conical geometry.

It is generally preferred that the second legs and the first legs are arranged in a non-symmetrical fashion (with respect to each other), particularly a non-mirror-symmetric fashion. This may apply to their respective height or thickness, and to their general longitudinal profile. The longitudinal profile of the profile of the respective legs is visible when viewed in a cross-sectional longitudinal side view. Preferably, the first legs at the first wall portion are arranged in a rectangular fashion, whereas the second legs at the second wall portion are arranged in a tapered fashion. More generally, the first legs may be larger in width (lateral extension) than at least a bottom region of the second legs.

In an exemplary embodiment, a longitudinal cross-sectional profile of the first legs is basically rectangular, along at least a substantial portion of the longitudinal extension thereof, wherein a longitudinal cross-sectional profile of the second legs is basically tapered, along at least a substantial portion of the longitudinal extension thereof. Tapering may involve at least one of a trapezoid shape, an elliptical shape, a semielliptical shape, an elliptical segment, and combinations thereof. Hence, longitudinal cross-sectional profiles of the first legs and the second legs, when viewed in a cross-sectional longitudinal view, are different from each other, particularly in a non-mirror-symmetric fashion. Needless to say, rounded or chamfered edges may be present at the respective profiles, particularly at edges thereof facing away from the guide slot. In other words, the first legs, if tapered at all, are not as much tapered as the second legs.

In a shaving operation mode, the first wall portion typically does not only face the skin but does also contact or touch the skin in the vicinity of the utilized toothed leading edge. In other words, generally the first wall portion may be arranged as the topmost component of the stationary blade, the blade set, and the hair cutting appliance.

In one embodiment of the stationary blade, the second legs of the teeth, when viewed in a longitudinal side view, comprise a tapered cross section, wherein the tapering extends from a skin facing side towards a side thereof that is facing away from the skin. The skin facing side may be referred to as top side. The side facing away from the skin may be referred to as bottom side. When viewed in the above-described cross-sectional view, the top side of the second legs is wider than the bottom side. In some embodiments, the bottom side of the second legs may end in a relatively pointy tip.

In another embodiment of the stationary blade, the second legs of the teeth comprise, when viewed in a longitudinal side view, a cross section that is arranged in a trapezoid fashion, wherein lateral side surface of the second legs are inclined with respect to a vertical plane that is perpendicular to a cutting plane defined by the first wall portion. The cutting edges of the first wall portion are arranged in the cutting plane. The vertical plane is basically perpendicular to the cutting plane and parallel to a longitudinal direction which corresponds to the main extension direction of the teeth of the stationary blade, at least in some embodiments. A trapezoid cross section of the second legs comprises two lateral sides or side surfaces that may be arranged in a basically mirror-symmetric fashion. Further, a long side is provided that is facing the first wall portion. Opposite to the long side a short side is provided that is facing away from the first wall portion. As a consequence, hairs that are arranged and/or deformed in a basically flat fashion may align with the lateral sides of the second legs as the lateral sides are inclined with respect to the vertical plane. In some embodiments, the cross section of the second legs of the teeth may be arranged in a triangular fashion.

In yet another refinement of this embodiment, the cross section of the second legs comprises a first lateral side surface and a second lateral side surface that is opposite to the first lateral side surface, wherein the first lateral side surface and the second lateral side surface are inclined towards one another. In some embodiments, the first lateral side surface and a second lateral side surface may be connected via a respective bottom side. In some embodiments, the first lateral side surface and the second lateral side surface may merge into one another at a common tip. It goes without saying that the cross section of the second legs that is referred-to hereinbefore may of course comprise rounded edges, rounded tips, chamfered edges, chamfered tips, etc.

In another refinement of the above-described aspect, the lateral side surfaces of the second legs are arranged at an inclination angle $\gamma$ (gamma) with respect to the vertical plane, wherein the inclination angle $\gamma$ is in the range of about 1.5° (degrees) to about 45°, preferably in the range of about 3.0° to about 30°, more preferably in the range of about 7.5° to about 22.5°. Hence, the bottom side of the tooth slots between the teeth of the stationary blade may be significantly widened and/or arranged in a funnel-like fashion. As a consequence, hairs can be caught that cannot be caught with a stationary blade that comprises tooth slots between neighboring teeth that are arranged in a basically rectangular fashion.

However, at least in some embodiments, the lateral side surfaces of the second legs may be convexly curved. In such an embodiment, the angle of inclination γ may be regarded as a respective angle between the vertical plane and a main tangent line to said convexly shaped surfaces.

In still another embodiment of the stationary blade, the first wall portion comprises, at respective inwardly facing surfaces, cutting edges that cooperate with corresponding cutting edges of a cutter blade, when in operation. In one embodiment, the first wall portion and also the second wall portion comprise, at their opposite inwardly facing surfaces, cutting edges that cooperate with corresponding cutting edges of a cutter blade, when in operation. In the latter embodiment, a tight fit of the cutter blade in the slot may be provided. It goes without saying that even though a tight (vertical) fit is provided that the cutter blade is arranged in a slidingly movable fashion in the guide slot. When both the first wall portion and the second wall portion are provided with cutting edges, hairs may be cut or chopped at both sides of the movable cutter blade. This may have the advantage that only particularly short remainders, if at all, may be trapped and stuck in the guide slot. In the alternative, embodiments of the stationary blade may be envisaged that do not implement cutting edges at the second wall portion. Accordingly, a defined gap between the movable cutter blade and the second wall portion may be provided at least sectionally at the second legs.

In a further embodiment of the stationary blade, the teeth of the stationary blade are at least partially tapered towards their tips. In other words, in accordance with this embodiment, the teeth may be tapered in their longitudinal extension. A respective tapering may be present at both the first wall portion and the second wall portion, at least at a transition region in the vicinity of the tips where the first wall portion and the second wall portion are interconnected. As a consequence, a respective tapering may be present in a respective cross-sectional view or an outline view (bottom or top orientation). Rather, the tapering of the second legs is typically oriented towards the bottom side, i.e. in the vertical direction. In combination, a tapering or narrowing in the longitudinal direction towards the tips of the teeth and a tapering or narrowing in the vertical direction towards the bottom side of the teeth may be provided. As a consequence, the hair catching capability of the blade set is even further improved.

The above embodiment may be refined in that the teeth, when viewed in a bottom view, comprise an outline that is arranged in a tapered fashion. Preferably, the outline comprises a rounded end at the tips.

In yet another embodiment of the stationary blade, the tapering of the teeth, when viewed in a longitudinal side view, defines slot spaces between the teeth that are configured to accommodate hairs that are arranged at a sharp angle β (beta) (or, at least a basically flat angle) with respect to a skin surface or an imaginary skin surface. As used herein, a sharp angle may involve an acute angle. Generally, a sharp angle may take values in the range of about 0° to about 60°, preferably in the range of about 5° to 30°, more preferably in the range of about 5° to 22.5°. It goes without saying that hairs are generally easily deformable. It is worth mentioning in this connection that the angle β between the teeth and the skin surface thus not necessarily has to match the or correspond to the inclination angle γ. Rather, the toothed leading edge of the stationary blade may act as a hair lifter and reach under the hairs so as to lift, bend and align flat hairs so as to allow them to enter the tooth slots between the teeth.

It may be further assumed in this connection that the above-mentioned angle β between the skin surface and the hairs may be regarded as a projected angle that is, regardless of an actual overall orientation of the hair, projected to a plane that is perpendicular to the longitudinal direction and/or the moving direction.

In yet another embodiment of the stationary blade, the slot spaces, when viewed in a longitudinal side view, are Y-shaped or funnel-shaped. Preferably, a tapered or inclined section of the slot spaces is associated with the second wall portion and a narrow section of the slot spaces is associated with the first wall portion. Also when viewed in a bottom view or top view, the slot spaces may be arranged in a Y-shaped or funnel-shaped fashion comprising a wide opening at the tips of the teeth and a narrow section at respective tooth bases.

So as to provide the stationary blade with the desired shape of the double-walled teeth thereof in a cost-efficient fashion, it is preferred that the stationary blade is obtained from manufacturing methods and approaches that enable, on the one hand, mass production and, on the other hand, enable to differently shape the first legs and the second legs of the teeth.

In the following, several exemplary manufacturing approaches will be presented and discussed. It goes without saying that the stationary blade in accordance with at least some aspects as described herein may be also shaped in a different fashion and obtained from at least slightly different manufacturing methods. However, some beneficial approaches that enable, on the one hand, to vary and/or adjust the thickness (height) of the first wall portion, the guide slot and the second wall portion which also implies that the first wall portion and the second wall portion may have different thicknesses, and, on the other hand, to shape, vary and adjust the (longitudinal) cross section of the second legs at the second wall portion with considerable freedom of design will be presented and discussed hereinafter.

In one exemplary embodiment, the stationary blade comprises a first layer defining the first wall portion, a second layer defining the second wall portion and an intermediate layer arranged between the first layer and the second layer, wherein the first layer, the second layer and the intermediate layer are formed from metal material, wherein each of the first layer and the second layer is formed from a sheet metal blank, wherein the first layer and the second layer are bonded to one another via the intermediate layer, thereby forming the tips, wherein the intermediate layer spaces the first layer and the second layer from one another to define the guide slot therebetween, and wherein the intermediate layer forms a transitional intermediate wall portion at the tips of the teeth.

In other words, the intermediate layer may, in terms of its thickness, define the height of the guide slot. Further, since the first layer, the second layer and the intermediate layer may be formed from different sheet metal blanks, the respective properties and dimensions may be adjusted to the intended purpose. Consequently, the thickness of the second layer may be different from, preferably larger than, the thickness of the first layer. So as to define the desired shape of the teeth and the guide slot, the first layer, the second layer and the intermediate layer may be processed, particularly subjected to material-removing processing. To this end, cutting processes, stamping processes, electrochemical machining, electrical discharge machining, wire spark eroding and further appropriate methods may be envisaged. Particularly the intermediate layer needs to be processed so as to define the guide slot therein.

The first layer, the intermediate layer and the second layer may be bonded to one another, for instance by welding, particularly by spot welding, laser welding, etc. Further, also soldering processes may be envisaged. By bonding the first layer, the second layer and the intermediate layer, a layered stack may be obtained. The layered stack may be referred to as an intermediate product. Typically, the layered stack is further processed so as to define and shape the teeth as desired. Consequently, the second legs of the teeth may be shaped in the desired fashion so as to implement the required narrowing or tapering.

In an alternative embodiment of the stationary blade, the stationary blade is arranged as an integrally formed metal-plastic composite stationary blade, wherein the first wall portion is at least partially made from sheet metal material, and wherein the second wall portion is at least partially made from plastic material that is molded to the sheet metal material. In other words, the stationary blade in accordance with this embodiment may be obtained from insert molding processes and/or overmolding processes. This embodiment is based on the insight that basically only the first wall portion that actually contacts the skin and implements respective cutting edges should be made from a respective appropriate metal material. In particular in embodiments wherein the second wall portion is not involved in the cutting operation as such, it may be beneficial to primarily shape the second wall portion from plastic material. It is worth mentioning in this connection that a respective boundary or separation between the first wall portion and the second wall portion does not necessarily have to correspond to a respective boundary between the plastic material and the metal material. In other words, in at least some embodiments the plastic material may form also part of the first wall portion. This may particularly apply to the tips of the teeth where the first wall portion and the second wall portion merge into each other. The tips of the teeth are not directly involved in the hair cutting or chopping process and therefore based on plastic material. An integrally formed metal-plastic composite stationary blade may be obtained from a highly automated cost-efficient manufacturing process.

In yet another embodiment of the stationary blade which may be, at least to some extent, also referred to as metal-plastic composite stationary blade, the stationary blade may comprise a plastic component, wherein the first wall portion and the second wall portion comprise an inner metal shell that is integrally made from a common metal component, particularly from a transformed sheet metal component, wherein the plastic component is molded to the metal component at a bottom side thereof facing away from the skin, when in operation, and wherein the tapering of the second legs is at least partially formed by the plastic component. In other words, a single metal component, particularly a single sheet metal strip may be bent by about 180° so as to define the metal shell that forms a considerable part of the first wall portion and the second wall portion. The plastic component may be molded to the metal component via overmolding, insert molding, etc. Particularly the plastic component may define rounded tips of the teeth of the stationary blade.

With respect to the desired tapering or narrowing of the second legs of the teeth, different embodiments may be envisaged in connection with the above-described manufacturing approach. In a first embodiment, the metal component at the second legs does not form part of the tapering. That is, in other words, primarily the plastic component that is molded to the bottom side of the metal component at the second legs that may be shaped in the desired fashion. In another alternative embodiment, also the metal component, at the second legs thereof, comprises a narrowed cross section and/or a tapering as indicated herein before.

In another aspect of the present disclosure, a blade set for a hair cutting appliance is presented, said blade set being arranged to be moved through hair in a moving direction to cut hair, said blade set comprising:

- a stationary blade in accordance with at least some embodiments of the present disclosure, and
- a movable cutter blade comprising at least one toothed leading edge, said movable cutter blade being movably arranged within the guide slot defined by the stationary blade, such that, upon relative motion between the movable cutter blade and the stationary blade, the at least one toothed leading edge of the stationary blade cooperates with corresponding teeth of the movable cutter blade to enable cutting of hair caught therebetween in a cutting action.

It is particularly preferred that the blade set consists of the stationary blade and the movable cutter blade. This of course may involve a respective force transmitting member for the movable cutter blade. Apart from that, it is preferred in at least some embodiments that the blade set comprises no further components. By way of example, it may be preferred that the movable cutter blade is arranged in the guide slot without being biased by a separate biasing member, such as a biasing spring element. Consequently, it is preferred that a top side of the movable cutter blade is in contact with the first wall portion and that a bottom side of the movable cutter blade is in contact with the second wall portion. It goes without saying that the movable cutter blade may be arranged in the guide slot with a defined clearance or in an at least slightly biased state with respect to the first wall portion and the second wall portion, respectively, since the movable cutter blade is preferably slidingly, but with little play, arranged in the guide slot.

Relative motion may involve reciprocating motion of the movable cutter blade with respect to the stationary blade, preferably a reciprocating linear motion. In some embodiments, relative motion may involve rotation of the movable cutter blade with respect to the stationary blade.

In yet another aspect of the present disclosure a hair cutting appliance is presented, particularly an electrically operated rooming appliance, the hair cutting appliance comprising:

- a housing accommodating a motor; and
- a blade set in accordance with at least some embodiments as described herein, wherein the stationary blade is releasably attached to the housing, and wherein the cutter blade, in the mounted state, is operably connected to the motor, such that the motor is capable of linearly driving or rotating the cutter blade within the guide slot of the stationary blade.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE EMBODIMENTS

Figure 1:
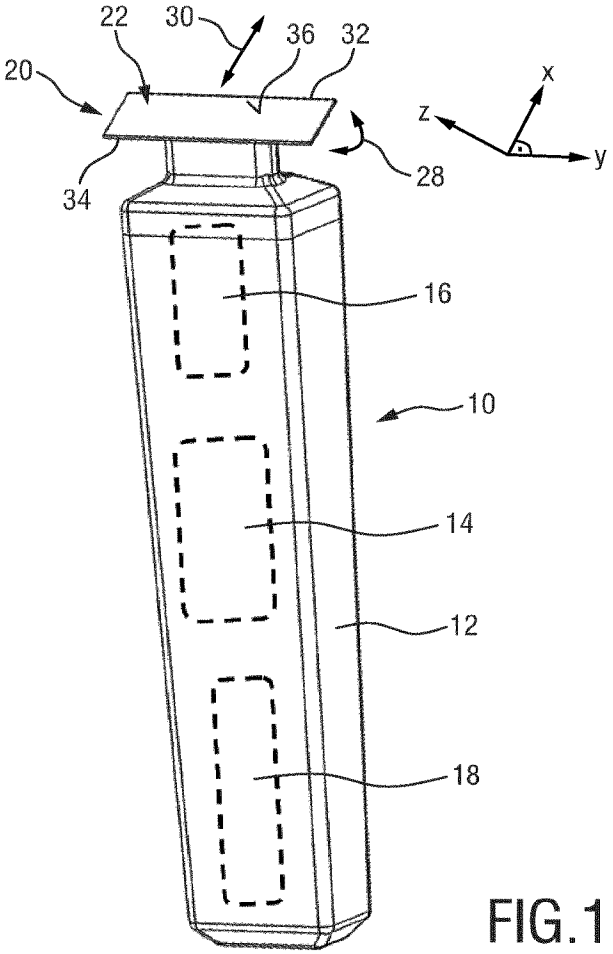
FIG. 1 shows a schematic perspective view of an exemplary hair cutting appliance including a cutting head implementing a blade set.

FIG. 1 schematically illustrates, in a simplified perspective view, an exemplary embodiment of the hair cutting appliance 10, particularly an electric hair cutting appliance. The hair cutting appliance 10 may comprise a housing or, more particularly, a housing portion 12, a motor indicated by a dashed block 14 in the housing portion 12, and a drive mechanism or drive train indicated by a dashed block 16 in the housing portion 12. For powering the motor 14, at least in some embodiments of the hair cutting appliance 10, an electrical battery, indicated by a dashed block 18 in the housing portion 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 18.

The hair cutting appliance 10 may further comprise a cutting head 20. At the cutting head 20, a blade set 22 may be attached to the hair cutting appliance 10. The blade set 22 may be driven by the motor 14 via the drive mechanism or drive train 16 to enable a cutting motion. The cutting motion may generally be regarded as a relative motion between a stationary blade and a movable cutter blade which will be further described and discussed hereinafter. Generally, a user may grasp, hold and manually guide cutting appliance 10 through hair in a moving direction 30 to cut hair. The cutting appliance 10 may be generally regarded as a hand-guided or hand-operated electrically powered device. Furthermore, the cutting head 20 or, more particularly, the blade set 22 can be connected to the housing portion 12 of the cutting appliance 10 in a pivotable manner, refer to the curved double-arrow indicated by reference numeral 28 in FIG. 1. In some applications, the cutting appliance 10 can be moved along skin to cut hair growing at the skin. When cutting hair closely to the skin, basically a shaving operation can be performed aiming at cutting or chopping hair at the level of the skin. However, also clipping (or trimming) operations may be envisaged, wherein the cutting head 20 comprising the blade set 22 is passed along a path at a desired distance relative to the skin.

When being guided through hair, the cutting appliance 10 including the blade set 22 is typically moved along a common moving direction which is indicated by the reference numeral 30 in FIG. 1. It is worth mentioning in this connection that, given that the hair cutting appliance 10 is typically manually guided and moved, the moving direction 30 thus not necessarily has to be construed as a precise geometric reference having a fixed definition and relation with respect to the orientation of the hair cutting appliance 10 and its cutting head 20. That is, an overall orientation of the hair cutting appliance 10 with respect to the to-be-cut hair at the skin may be construed as somewhat unsteady. However, for illustrative purposes, it may be fairly assumed that the (imaginary) moving direction 30 is parallel (or generally parallel) to a main central plane of a coordinate system which may serve in a following as a means for describing structural feature of the hair cutting appliance 10.

For ease of reference, coordinate systems are indicated in several drawings herein. By way of example, a Cartesian coordinate system X-Y-Z is indicated in FIG. 1. An axis X of the respective coordinate system extends in a generally longitudinal direction that is generally associated with length, for the purpose of this disclosure. An axis Y of the coordinate system extends in a lateral (or transverse) direction associated with width, for the purpose of this disclosure. An axis Z of the coordinate system extends in a height (or vertical) direction which may be referred to for illustrative purposes, at least in some embodiments, as a generally vertical direction. It goes without saying that an association of the coordinate system X-Y-Z to characteristic features and/or embodiment of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including alternative orientations. It is further worth mentioning that, for the purpose of the present disclosure, the coordinate system X-Y-Z is generally aligned with main directions and orientations of the cutting head 20, particularly of the blade set 22 thereof.

Figure 2:
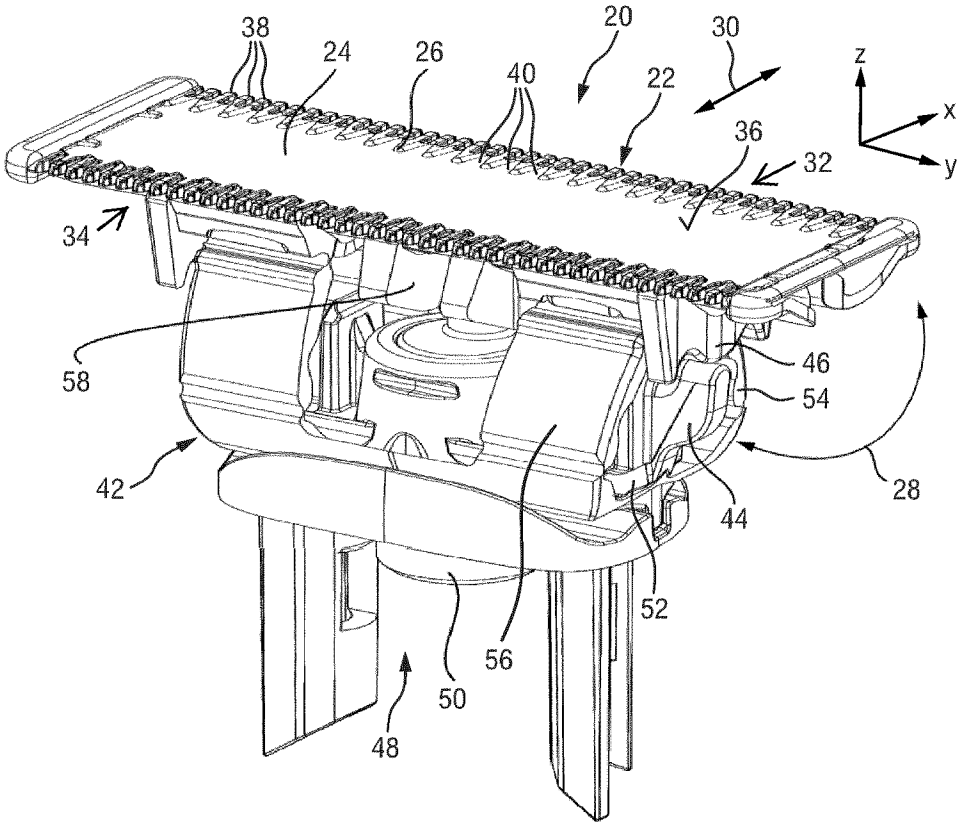
FIG. 2 shows a perspective top view of a blade set of a cutting head for a hair cutting appliance.

FIG. 2 shows a perspective top view of a blade set 22 that may be implemented in the cutting head 20 illustrated in FIG. 1. The blade set 22 comprises a stationary blade 24 and a cutter blade 26 that may be moved with respect to the stationary blade 24 in a reciprocating motion. The stationary blade 24 and the cutter blade 26 may jointly define at least one toothed leading edge 32, 34, preferably a first toothed leading edge 32 and a second toothed leading edge 34. The first toothed leading edge 32 and the second toothed leading edge 34 are arranged in parallel fashion and facing away from each other. The movable cutter blade 26 is indicated in FIG. 2 in a dashed representation. The cutter blade 26 may be driven by a drive shaft 50 in a reciprocating manner. Consequently, the cutter blade 26 and the stationary blade 24 may be reciprocatingly moved with respect to each other and therefore cooperate to cut hairs that enter slots between teeth 38 of the stationary blade 24 and teeth 40 of the cutter blade 26 at the respective leading edges 32, 34 when the hair cutting appliance 10 is moved through hair in the moving direction 30.

The stationary blade 24 may be arranged as a guard for the movable cutter blade 26. It is particularly preferred that the stationary blade 24 comprises a first wall portion and a secondary wall portion which are at least partially spaced from each other such that a guide slot for the cutter blade 26 is defined therebetween, refer also to the cross-sectional representations of the blade set 22 in FIGS. 4, 5 and 6. As a consequence, the stationary blade 24 may also cover the cutter blade 26 at the at least one toothed leading edge 32, 34.

As already indicated above, the blade set 22 may be particularly suited for shaving and trimming operations. Shaving performance and trimming performance may be further improved when the blade set 22 is capable of following an actual skin contour. Consequently, it is particularly preferred that the blade set 22 is attachable to the housing portion 12 of the hair cutting appliance 10 in a pivotable fashion. A swiveling mechanism is indicated in FIG. 2 by reference numeral 42. The blade set 22 is attached to the swiveling mechanism 42. The swiveling mechanism 42 may form a part of the cutting head 20 that is interposed between the blade set 22 and the housing portion 12. The swiveling mechanism 42 may define a pivot or, rather, a virtual pivot for the blade set 22, refer to the curved double-arrow 28 in FIGS. 1 and 2.

So as to define a maximum swiveling angle of the blade set 22 with respect to the housing portion 12, the swiveling mechanism 42 may comprise a limit stop 44 that may cooperate with a contact surface 46 to define an allowed range of the swiveling motion. By way of example, the swiveling mechanism 42 may be arranged as a four-bar-linkage mechanism. In this embodiment, the swiveling mechanism 42 comprises a base link 52 that may be attached to the housing portion 12. A first side link 54 and a second side link 56 may be coupled to the base link 52. At a top end thereof, the swiveling mechanism 42 may comprise a top link 58 that connects the first side link 54 and the second side link 56. Between the respective links 52, 54, 56, 58 hinges may be provided, particularly living hinges, that enable relative rotation between neighboring links and thus the overall pivoting motion.

Generally, at least in some embodiments, the cutting head 20 may be regarded as a replaceable and/or a detachable cutting head. To this end, the cutting 20 may comprise an attachment interface 48 which is arranged to engage a respective receiving interface at the housing portion 12 of the hair cutting appliance 10. Particularly, the cutting head 20 may be arranged as a plug-in cutting head 20. As already indicated above, the blade set 22, particularly the cutter blade 26 thereof, may be coupled to the drive shaft 50. The drive shaft 50 may comprise an eccentric portion that may revolve about a longitudinal axis of the drive shaft 50. Consequently, an eccentric drive mechanism 16 may be provided for driving the cutter blade 26 in a reciprocating fashion with respect to the stationary blade 24.

Being fitted with the swiveling mechanism 42 as exemplarily illustrated in FIG. 2 or with another exemplary embodiment of a swiveling mechanism, the cutting head 20 may be particularly suited for shaving operations. However, it is further preferred that the hair cutting appliance 10 is also suited for hair trimming operations. Hair trimming may involve cutting hairs at a desired length. The desired remaining length of the hairs may be defined by a so-called attachment comb.

Figure 3:
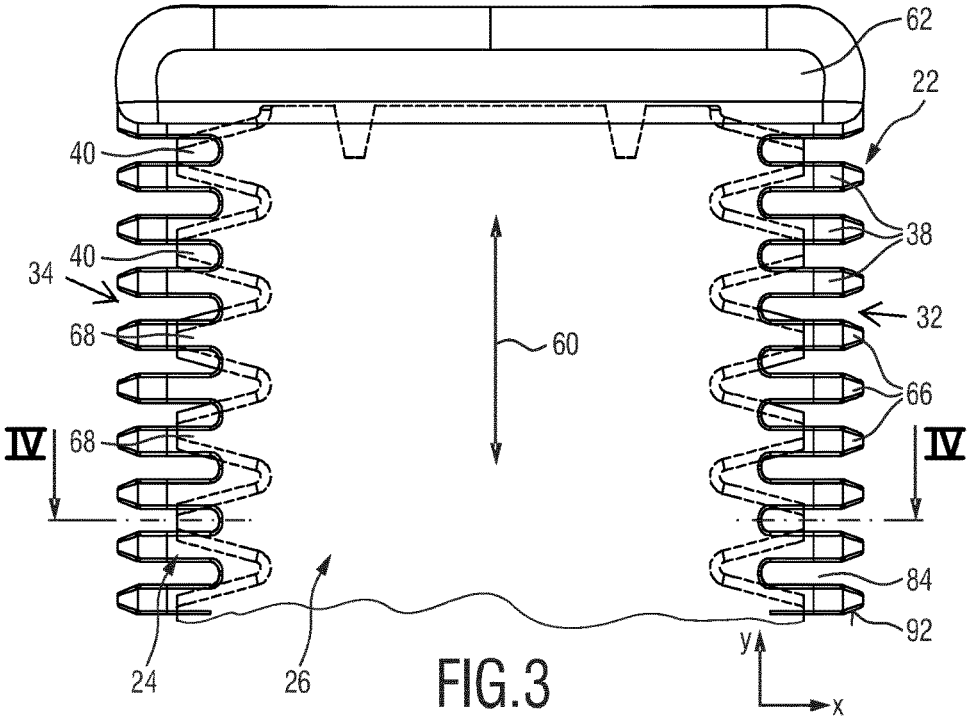
FIG. 3 shows a partial top view of an exemplary embodiment of a blade set.
Figure 4:
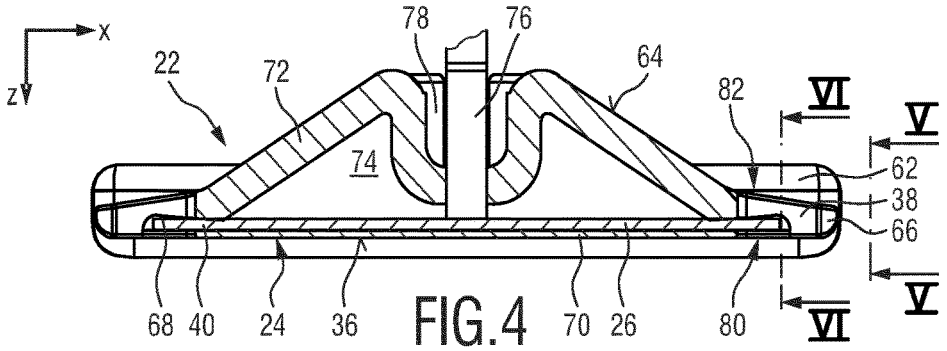
FIG. 4 shows a cross-sectional lateral side view of the blade set as shown in FIG. 3 taken along the line IV-IV in FIG. 3.

FIG. 3 is a partial top view of a blade set 22 that is basically arranged in accordance with the arrangement of the blade set 22 as shown in FIG. 2. FIG. 4 is a corresponding cross-sectional lateral side view. As indicated by an arrow that is designated by reference numeral 60 in FIG. 3, the movable cutter blade 26 may be operated so as to be moved with respect to the stationary blade 24 in a reciprocating fashion. As a consequence, respective teeth 38 of the stationary blade 24 and teeth 40 of the movable cutter blade 26 may cooperate to cut hairs therebetween. As can be further seen from FIG. 3, a lateral end portion 62 may be provided at respective lateral ends of the stationary blade 24. As indicated in FIG. 4, a top side or skin-facing side of the blade set 22 is indicated by reference numeral 36. Correspondingly, a side that is opposite to the top side 36 which may be therefore referred to as bottom side or as a side that is facing away from the skin is designated in FIG. 4 by reference numeral 64.

Figure 6:
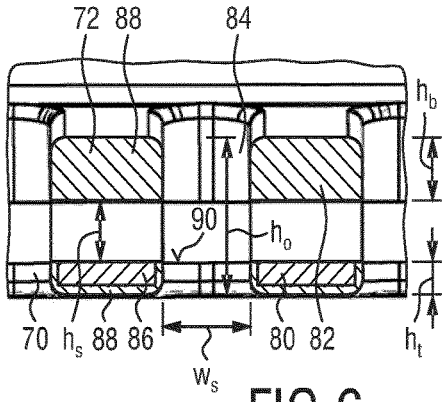
FIG. 6 is another partial cross-sectional longitudinal side view of the arrangement of FIG. 5 taken along the line VI-VI in FIG. 4.

At respective longitudinal ends of the teeth 38 of the stationary blade 24, tips 66 are provided. At respective longitudinal ends of the teeth 40 of the movable cutter blade 26, tips 68 are provided. As can be best seen from FIG. 4, the tips 66 of the teeth 38 protrude beyond the tips 68 of the teeth 40 in the longitudinal direction X. Furthermore, as a first wall portion 70 and a second wall portion 72 is provided at the stationary blade 24, the teeth 38 thereof including their tips 66 may somewhat embrace, cover or guard the teeth 40 of the movable cutter blade 26 including their tips 68. Furthermore, as a somewhat closed design of the stationary blade 26 is achieved in this way, the stationary blade 24 may be arranged in a considerably stiff and rigid fashion. The first wall portion 70 and the second wall portion 72 of the stationary blade 24 are spaced from each other so as to define a guide slot 74 therebetween. An effective height $h_s$ of the guide slot 74 is indicated in FIG. 6. Preferably, the height $h_s$ of the guide slot 74 is adapted to the height or thickness of the movable cutter blade 26 so as to enable a tight fit arrangement of the movable cutter blade in the guide slot 74.

As can be further seen from FIG. 4 (refer also to FIG. 23), a transmitter 76 may be provided at and coupled to the cutter blade 26. The transmitter 76 is basically arranged to be engaged by the drive shaft 50 as shown in FIG. 2. Furthermore, a guide arrangement 78, particularly a longitudinal guide arrangement 78 that defines the longitudinal position of the movable cutter blade 26 with respect to the stationary blade may be provided at the bottom side (second wall portion 72) of the stationary blade 24. The guide arrangement 78 may for instance comprise an at least partially laterally extending slot in which the transmitter 76 is received in a sliding fashion.

As already indicated above, the teeth 38 of the stationary blade 24 are basically defined by the first wall portion 70, at the top side 36, and the second wall portion 72, at the bottom side 64. In other words, the teeth 38, when viewed in a cross-sectional lateral side view, may comprise a basically U-shaped cross section. Hence, a first leg 80 and a second leg 82 may be provided and respectively defined by the first wall portion 70 and the second wall portion 72. The teeth 40 of the movable cutter blade 26 are received between the first leg 80 and the second leg 82.

Figure 5:
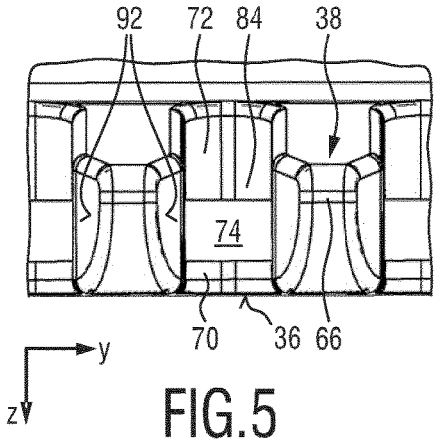
FIG. 5 is a partial longitudinal side view of the blade set as shown in FIG. 3 and FIG. 4, wherein an orientation of the view of FIG. 5 is indicated by the line V-V in FIG. 4, and wherein the movable cutter blade has been omitted for illustrative purposes.

Between neighboring teeth 38 of the stationary blade 24 respective tooth slots 84 may be provided which may be also referred to as slot spaces. Basically, to-be-cut hairs have to enter the tooth slots 84 to be cut or chopped therein in a cooperating cutting action between the stationary blade 24 and the movable cutter blade 26. FIG. 5 and FIG. 6 show partial longitudinal side views of the stationary blade 24 as illustrated in FIGS. 3 and 4. For illustrative purposes, the movable cutter blade 26 is not shown in FIGS. 5 and 6. Respective lines V-V and VI-VI in FIG. 4 indicate the orientation and position of the views of FIG. 5 and FIG. 6. The arrangement as illustrated in FIG. 5 and FIG. 6 is conventional insofar as the longitudinal cross section or profile of the teeth 38 or, more particularly, their first legs 80 and second legs 82 is basically rectangular. As a consequence, also the tooth slots 84 are arranged in a basically rectangular fashion. An overall height II, of the tooth slots 84 is indicated in FIG. 6. The overall height II, is basically composed of the height $h_s$ of the guide slot 74, the height $h_t$ of the first leg 80 and the height $h_b$ of the second leg 82. A width $w_s$ of the tooth slots 84 is indicated in FIG. 6 as well.

As further indicated in FIG. 6, the stationary blade 24 may be arranged at least in some embodiments as described herein as an integrally formed metal plastic composite part. By way of example, a metal component 86 may be provided that forms at least a substantial part of the first wall portion 70 or the first leg 80. Furthermore, a plastic component 88 may be provided that may form at least a substantial part of the second wall portion 72 or the second leg 82. Forming the stationary blade 24 as a composite component that comprises a metal component 86 and a plastic component 88 may have the advantage that particularly the second legs 82 of the teeth 38 may be adequately shaped in a vertically tapered fashion so as to improve the hair catching capability of the blade set 22. As can be further seen from FIG. 6, a cutting plane 90 may be defined by the bottom side of the first wall portion 70 or, more particularly, of the first legs 80 of the teeth 38 that is opposite to the top side or top face 36.

Further reference is made to FIG. 5. As shown in FIG. 5 and in the corresponding top view of FIG. 3, the tips 66 of the teeth 38 may be provided with a respective longitudinally extending tip tapering 92. The longitudinal tapering 92 may be arranged such that, when viewed in a top view orientation as shown in FIG. 3, the tooth slots 84 are arranged in a basically funnel-like, constricted or tapered fashion.

Figure 7:
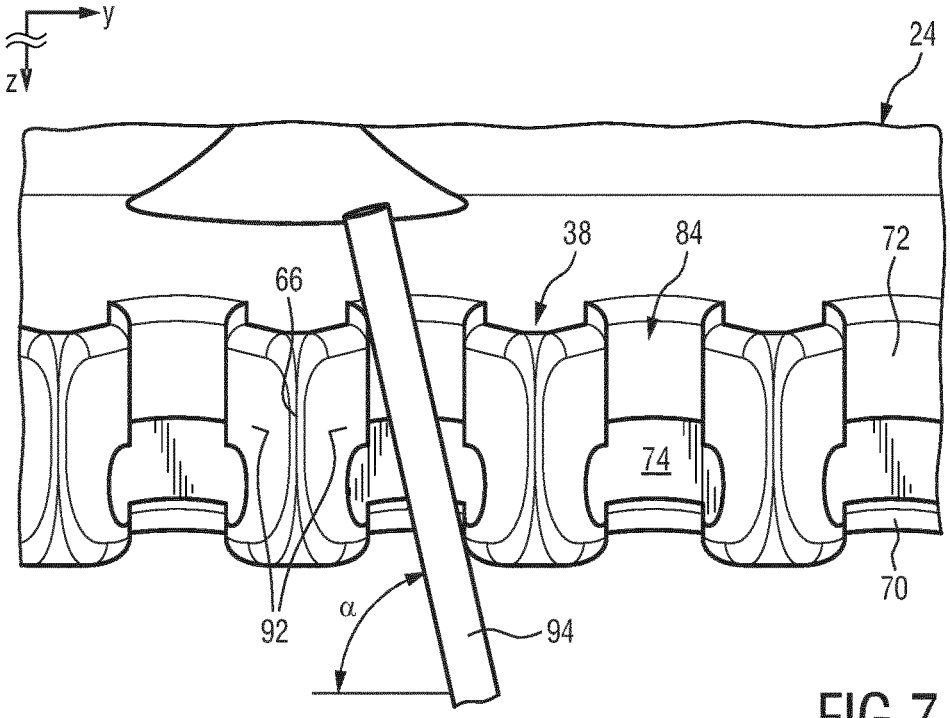
FIG. 7 is a partial perspective longitudinal side view of an embodiment of a stationary blade for a blade set.
Figure 8:
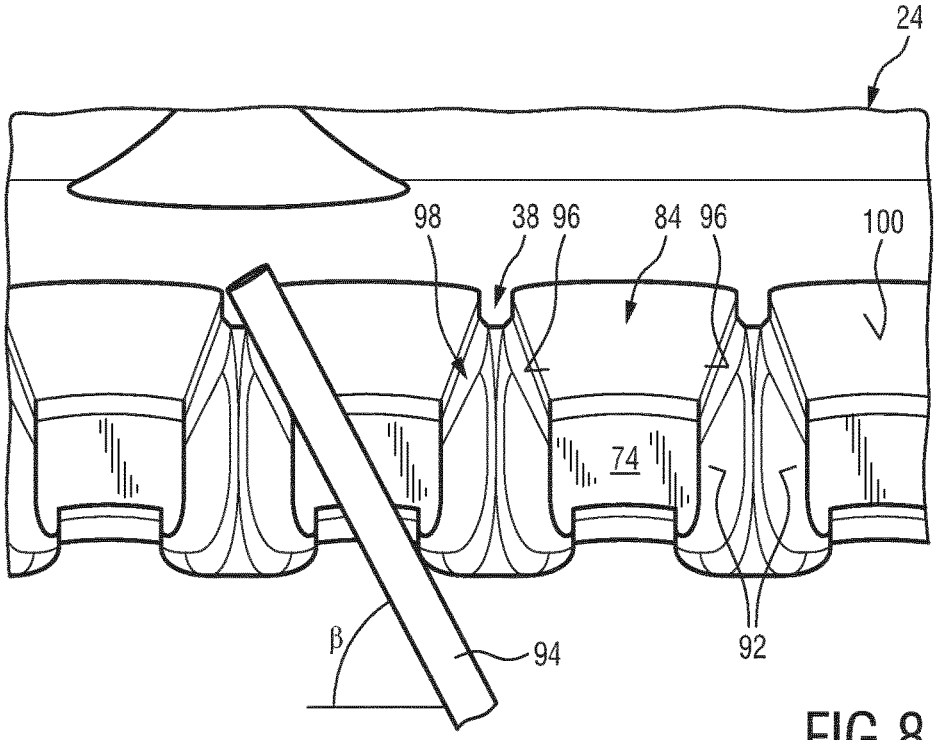
FIG. 8 is a partial perspective longitudinal side view of yet another embodiment of a stationary blade for a blade set.

Further reference is made to FIGS. 7 and 8 illustrating slightly tilted (about the lateral axis Y) longitudinal side views of two exemplary embodiments of stationary blades 24. In other words, the vertical direction or height direction Z indicated by an arrow of the coordinate system of FIGS. 7 and 8 is somewhat inclined with respect to the view orientation plane thereof. FIG. 7 shows a conventional arrangement of a respective double-walled stationary blade 24 that comprises a first wall portion 70 and a second wall portion 72 that define therebetween a guide slot 74. Furthermore, a series of teeth 38 is provided that alternate with respective tooth slots 84. The teeth 38 and the tooth slots 84 are provided with basically rectangular shapes and outlines when viewed in a longitudinal side view, refer also to the cross-sectional illustration of FIG. 6 that describes a similar arrangement.

At the tips 66 of the teeth 38, a longitudinal tip tapering 92 may be provided. However, at a rear portion of the teeth 38, the respective second legs 82 may comprise a basically rectangular cross section. This may have the effect that only hair filaments 94 that are arranged at a considerably large angle $\alpha$ (alpha) may enter the tooth slots 84 with little efforts. In case the angle of orientation a between the hair filaments 94 and the skin surface becomes too small, the hair catching performance of the stationary blade 24 may be deteriorated.

Therefore, in accordance with an aspect of the present disclosure, it may be advantageous to arrange lateral side surfaces 96 of the second legs 82 of the teeth 38 in a tilted or inclined manner with respect to a basically vertical plane that is defined by the longitudinal direction X and the vertical direction Z. Further reference is made to FIG. 8. As a consequence, a (vertical) tapering 98 may be provided at the teeth 38, particularly at the second legs 82 thereof. This may have the advantage that hair filaments 94 that are arranged in a basically flat fashion with respect to the skin surface may still easily enter the tooth slots 84, refer to FIG. 8. By providing the vertical tapering 98 at the teeth 38, also hair filaments 94 that are arranged at a considerably small angle $\beta$ (beta) with respect to the skin may be efficiently caught and cut. As a consequence, particularly the shaving or trimming performance of the blade set 22 may be increased. The more hairs may enter the tooth slots 84 at a single stroke, the quicker the hair cutting operation may be eventually accomplished. Also at the rear ends of the tooth slots 84, as shown in FIG. 8, a conical section 100 which may also be referred to as tapered section or funnel section may be provided.

Reference is made to FIGS. 9 to 13 illustrating exemplary embodiments of teeth 38 of stationary blades 24 that are arranged in a beneficial tapered fashion.

Figure 9:
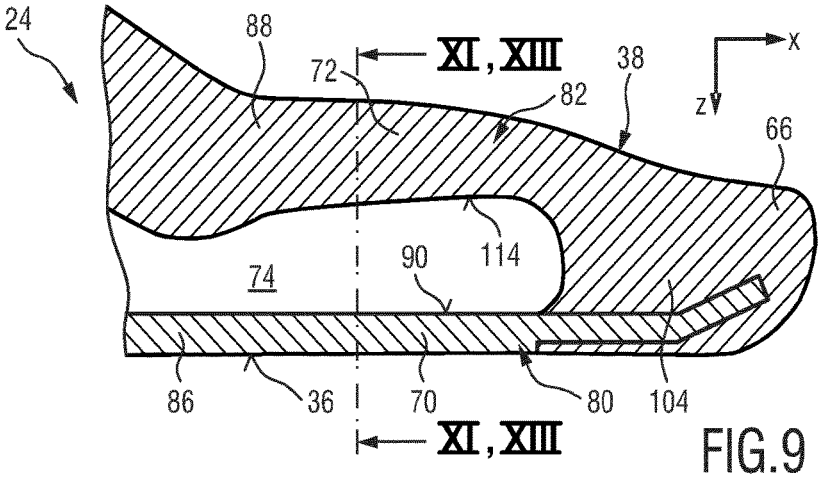
FIG. 9 is a partial simplified schematic cross-sectional lateral side view of an embodiment of a stationary blade.

As can be best seen from FIG. 9, the stationary blade 24 may be composed of a metal component 86 and a plastic component 88. As with the embodiment of FIG. 9, the metal component 86 forms a substantial part of the first wall portion 70 and therefore also of the first legs 80. Further, the plastic component 88 forms the second wall portion 72 and, as a consequence, the second leg 82. At the tips 66 of the teeth 38, the first wall portion 70 and the second wall portion 72 are coupled to each other via an intermediate wall portion 104. As with the embodiment of FIG. 9, the intermediate wall portion 104 is primarily formed by the plastic component 88.

It can be further seen from FIG. 9 that the guide slot 74 does not necessarily have to comprise a rectangular profile. Primarily at the first wall portion 70, an even cutting plane 90 may be provided at the first legs 80 of the teeth 38. However, at the bottom side of the guide slot 74 not in each case a respective plane surface needs to be provided, refer to the corresponding top surface 114 of the second legs 82.

Figure 10:
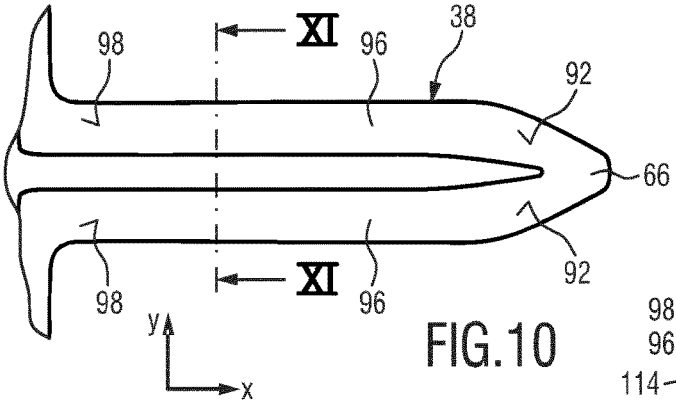
FIG. 10 is a partial simplified schematic bottom view of an exemplary embodiment of a stationary blade.
Figure 11:
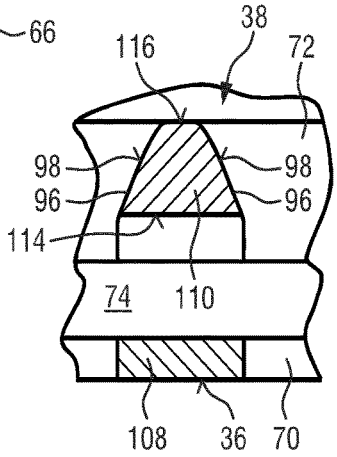
FIG. 11 is a partial cross-sectional longitudinal side view of the arrangement of FIG. 10 taken along the line XI-XI in FIG. 10.
Figure 12:
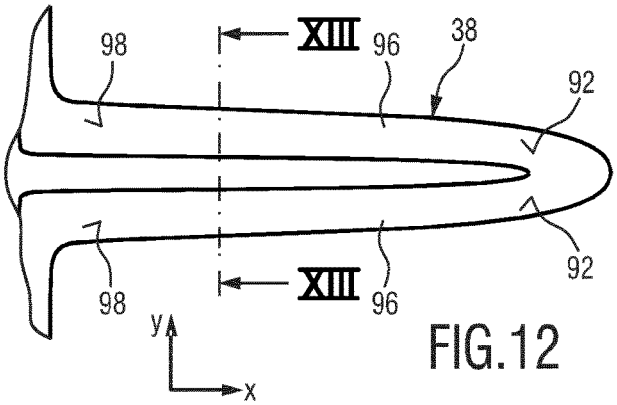
FIG. 12 is a partial simplified schematic bottom view of yet another exemplary embodiment of a stationary blade.
Figure 13:
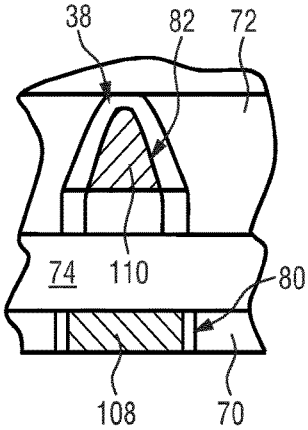
FIG. 13 is a partial cross-sectional longitudinal side view of the arrangement of FIG. 12 taken along the line XIII-XIII in FIG. 12.

FIG. 10 and FIG. 11 illustrate a bottom view and a corresponding longitudinal cross-sectional side view of a first embodiment of a tapering of the teeth 38. FIG. 12 and FIG. 13 illustrate a bottom view and a corresponding longitudinal cross-sectional side view of a second embodiment of a respective tapering of the teeth 38. The location of the cross section of FIGS. 11 and 13 is indicated in FIGS. 9, 10, and 12 by respective lines XI-XI and XIII-XIII.

The embodiment of FIGS. 10 and 11 comprises a longitudinally extending tapering 92 that is basically provided at the tips 66 of the teeth 38. Adjacent to the longitudinal tapering 92, a vertically extending tapering 98 is provided. In other words, at least at the side surfaces 96, the outer profile of the respective second legs 82 may be basically constant along a substantial portion of their longitudinal extension shown in FIG. 11 as having parallel walls from which the tapering 98 extends vertically towards the tip 66.

However, as can be clearly seen from FIG. 9, at a top side or top surface 114 of the second legs 82, the respective cross section of the second legs 82 may vary along their longitudinal extension. In other words, the top surface 114 may be curved with respect to the longitudinal direction X.

A cross section of the second wall portion 72 or, rather, the second leg 82 is indicated by reference numeral 110 in FIGS. 11 and 13. A corresponding cross section of the first wall portion 70 and the first leg 80 is indicated by reference numeral 108 in FIGS. 11 and 13.

In contrast to the arrangement as shown in FIGS. 10 and 11, the arrangement of FIGS. 12 and 13 comprises a cross section 110 that gradually changes along the longitudinal extension of the second leg 82. In other words, adjacent to the tip 66, the cross section 110 is significantly smaller in size than adjacent to a rear end of the second leg 82 that is opposite to the tip 66. Basically the same may apply to the cross section 108 of the first leg 80.

In both FIGS. 11 and 13, the cross section 110 is arranged in a basically trapezoid fashion. In other words, the side surfaces 96 are provided with a respective tapering 98 and therefore inclined with respect to each other. The side surfaces 96 extend between the top surface 114 and a bottom surface 116 that is facing away from the skin. Generally, the bottom surface 116 is smaller than the top surface 114. The same applies to the embodiment of FIG. 13.

Reference is made to FIGS. 14 to 19, illustrating further embodiments of respective taperings 92, 98 of teeth 38 that may improve the hair catching capabilities of the stationary blade 24. In each of the embodiments of FIGS. 14 to 19, the first leg 80 that is defined by the first wall portion 70 is basically arranged in a rectangularly profiled fashion. By contrast, the second leg 82 that is formed by the second wall portion 72 is arranged in a basically tapered fashion. The tapering may comprise a longitudinal tapering 92 which may also be referred to as tip tapering. Further, a vertical tapering 98 may be provided that is present at the respective cross sections or profiles as shown in FIGS. 14 to 18.

Figure 14:
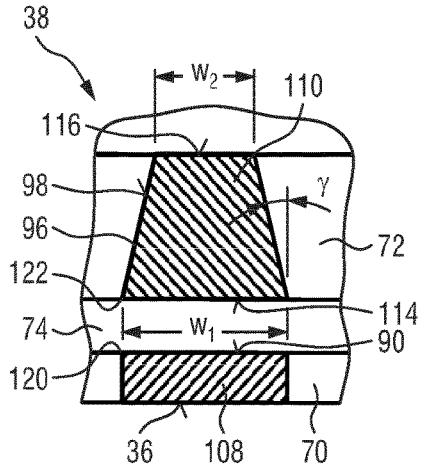
FIG. 14 is a partial simplified schematic cross-sectional longitudinal side view of an embodiment of a tooth of a stationary blade.

FIG. 14 illustrates an embodiment that may basically correspond to the embodiment as shown in FIGS. 10 and 11. Correspondingly, a cross section 110 of the second leg 82 may be provided that is shaped in a basically trapezoid fashion. The cross section 110 may be constant along a considerable portion of the longitudinal extension of the second leg 92 of the teeth 38. The side surfaces 96 may be arranged at an angle γ (gamma) with respect to a vertical plane is defined by the vertical direction Z and the longitudinal direction X. The angle of inclination γ may be in the range of about 0.5° to about 45°, preferably in the range of about 3° to about 30°, more preferably in the range of about 3° to about 22.5°. Furthermore, needless to say, the edges of the cross section or profile of the second leg 82 may be rounded or chamfered. Due to the tapering of the profile or cross section 110, the width $w_2$ of the bottom surface 116 may be significantly smaller than the corresponding width $w_1$ of the top surface 114.

The cutting plane 90 provided at the top side of the guide slot 74 is defined by cutting edges 120 provided at the first wall portion 70 or first leg 80. In some embodiments, also the second wall portion 72 or the second leg 82 may be provided with respective cutting edges 122 adjacent to the guide slot 74. The cutting edges 120 and, if any, the cutting edges 122 may corporate with corresponding cutting edges of the movable cutter blade 26 to cut hair.

FIGS. 15 to 19 illustrate embodiments wherein the vertical tapering 98 is overlayed or superimposed by a further tapering 92 that is basically extending in the longitudinal direction, as with the embodiment of FIGS. 12 and 13. As a result, the cross section 110 is gradually reduced towards the tips 66 of the respective teeth 38. By contrast, as with the embodiments of FIGS. 10, 11, and 14, the cross section 110 is basically constant along a substantial portion of its longitudinal extension.

Figure 15:
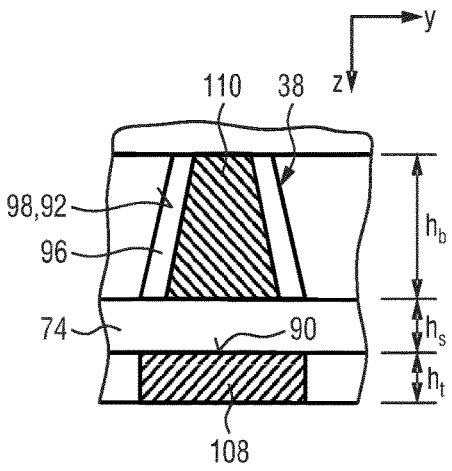
FIG. 15 is a partial simplified schematic cross-sectional longitudinal side view of another embodiment of a tooth of a stationary blade.
Figure 16:
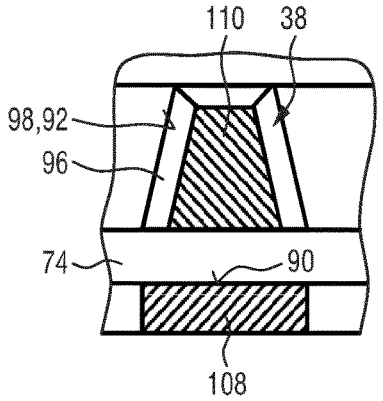
FIG. 16 partial is a simplified schematic cross-sectional longitudinal side view of yet another embodiment of a tooth of a stationary blade.
Figure 17:
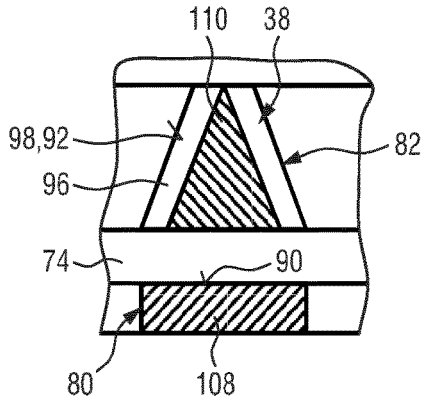
FIG. 17 is a partial simplified schematic cross-sectional longitudinal side view of: still another embodiment of a teeth of a stationary blade.
Figure 18:
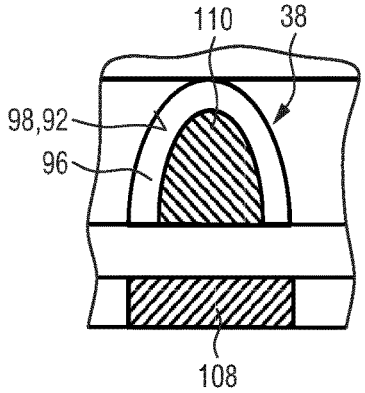
FIG. 18 is a partial simplified schematic cross-sectional longitudinal side view of still yet another embodiment of a tooth of a stationary blade.
Figure 19:
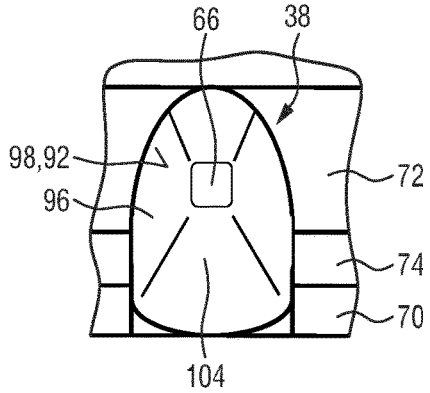
FIG. 19 is a partial simplified schematic longitudinal side view of the arrangement of FIG. 18.

FIGS. 15 and 16 illustrate embodiments that implement a trapezoid cross section or profile 110. FIG. 17 illustrates an embodiment that implements a triangular cross section 110. FIG. 18 illustrates an embodiment that implements a half-elliptical cross section 110. FIG. 19 is a corresponding lateral side view (not including a cross-sectional representation) of the view of FIG. 18.

As with the embodiments of FIGS. 15 and 17, the height $h_b$ or thickness of the cross section 110 of the second leg 82 is basically constant along at least part of its longitudinal extension. As with the embodiment of FIGS. 16 and 18, the respective height $h_b$ is gradually reduced towards the tips 66 of the teeth.

It goes without saying that the desired tapering (vertical tapering 98 which may be overlayed by a longitudinal tapering 92) of the second legs 82 of the teeth 38 may be provided by further alternative shapes and outlines. Generally, the tapering is intended to increase the hair catching capability of the stationary blade 24. The tapering may be arranged such that, when viewed in a longitudinal side view, profiles or outlines of the tooth slots 84 that are provided between respective) teeth 38 may be arranged in a basically Y-like fashion or funnel-like fashion including a widening at the bottom side and a narrowing at the tip side. This provides the stationary blade 24 with the capability of catching and cutting also hairs that are arranged at a considerably flat fashion with respect to the skin surface.

Further reference is made to FIGS. 20 to 30 illustrating several alternative embodiments of stationary blades 24. In each case, the stationary blade 24 is arranged as a double-sided or double-walled stationary blade 24 such that a respective guide slot 74 is provided wherein a movable cutter blade may be received.

Figure 20:
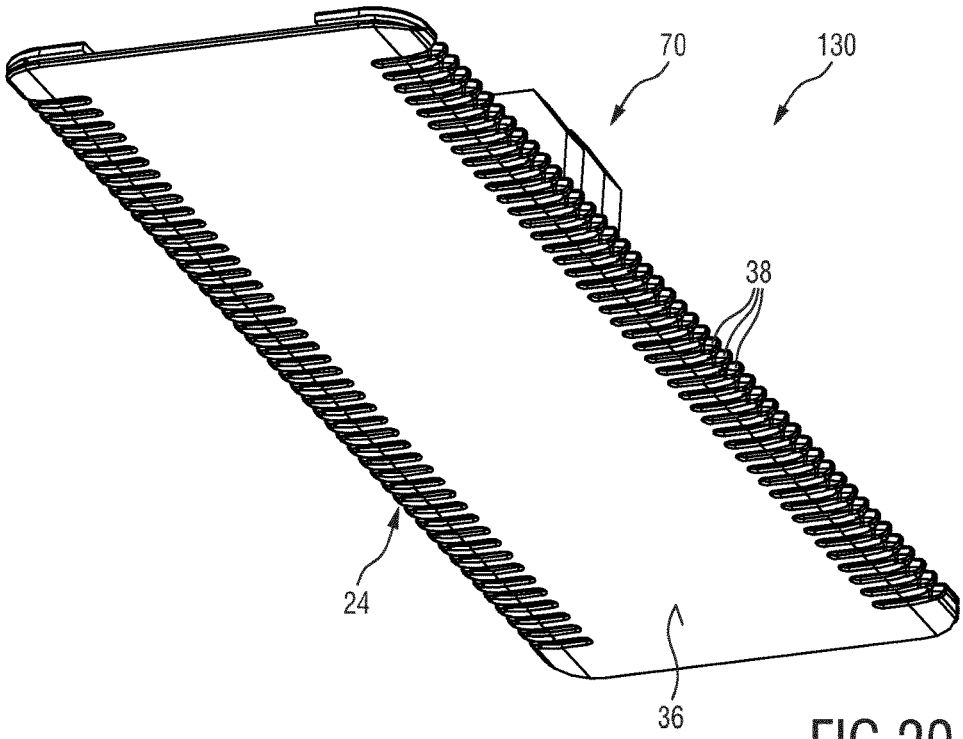
FIG. 20 is a perspective top view of another embodiment of a blade set.
Figure 21:
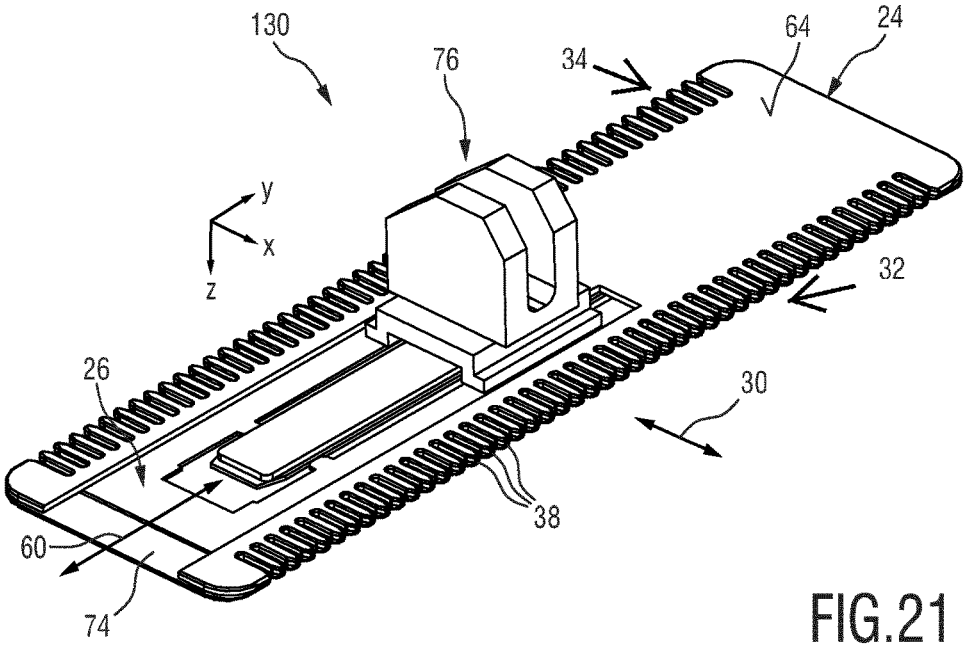
FIG. 21 is a perspective bottom view of the blade set as shown in FIG. 20.
Figure 22:
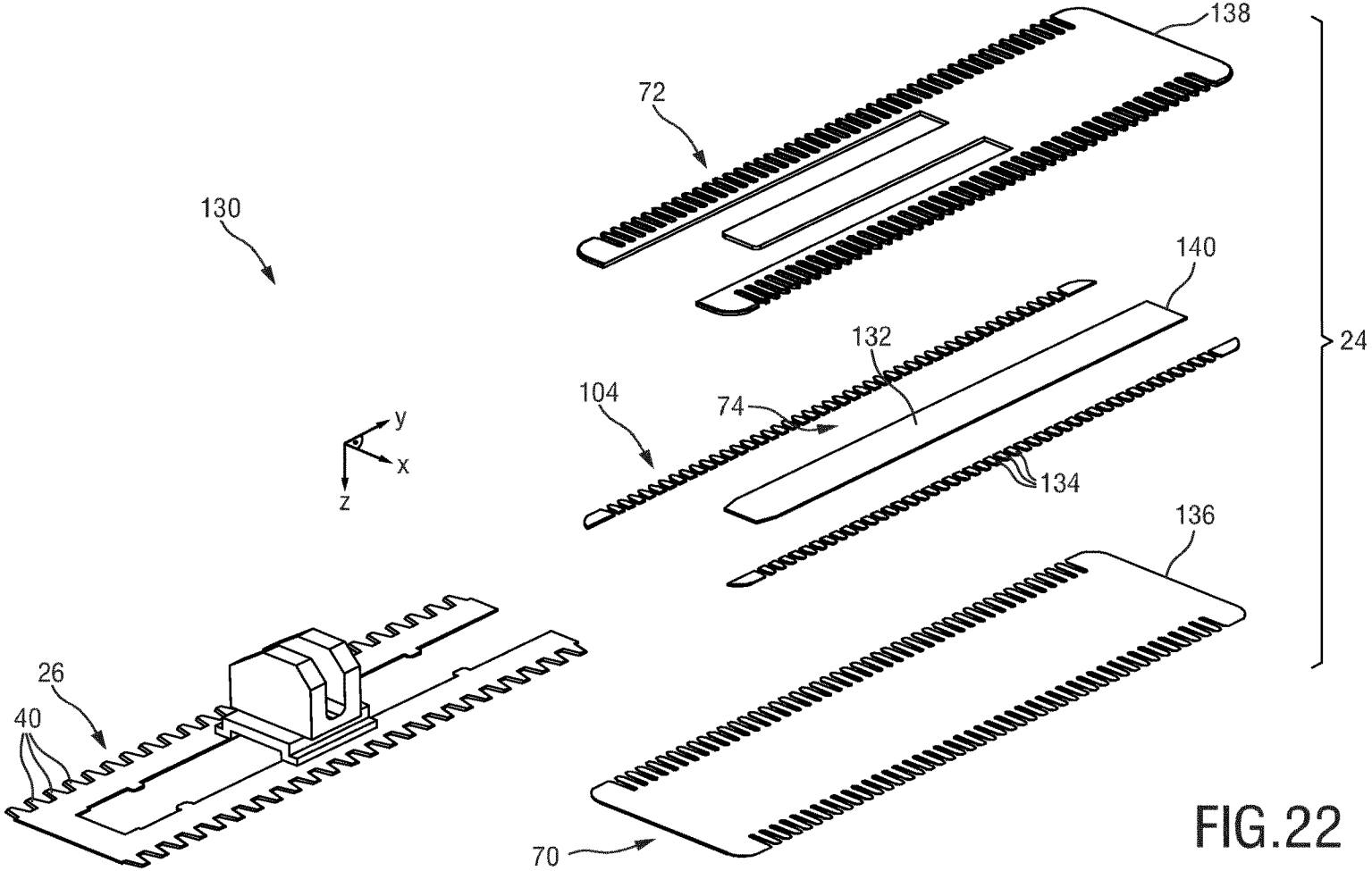
FIG. 22 is an exploded perspective bottom view of the blade set shown in FIG. 20 and FIG. 21.

A first exemplary arrangement of a blade set 130 is illustrated in FIGS. 20, 21, and 22. FIG. 20 shows a perspective top view of the blade set 130. FIG. 21 shows a perspective bottom view of the blade set 130. FIG. 22 shows a perspective exploded bottom view of the blade set 130. It is worth mentioning in this connection that the exploded state of the stationary blade 24 as shown in FIG. 22 does not necessarily have to correspond to an actual present state of the respective components thereof in practice in the course of manufacturing the stationary blade 24.

As with the embodiment of FIGS. 20, 21, and 22, the stationary blade 24 is arranged as a layered stack that is basically composed of a first wall portion 70, a second wall portion 72 and an intermediate wall portion 104 that is interposed therebetween. Each of the wall portions 70, 72, 104 may be obtained from a respective sheet metal blank. Particularly the intermediate wall portion 104 may be processed so as to define the guide slot 74 between the first wall portion 70 and the second wall portion 72. In other words, the height of a sheet metal blank the intermediate wall portion 104 is obtained from basically corresponds to the height $h_s$ of the guide slot 74. In the guide slot 74 the movable cutter blade 26 may be slidingly received. Furthermore, at the level of the intermediate wall portion 104, a central guide plate 132 may be defined which cooperates with a corresponding laterally extending guide slot of the movable cutter blade 26 so as to receive the movable cutter blade 26 in a defined manner.

In the course of manufacturing the stationary blade 24, initially the sheet metal blanks the respective wall portions 70, 72, 104 may be formed from may be present as basically continuously extending components or layers 136, 138, 140. In other words, the first wall portion 70 may be defined by a first layer 136. The second wall portion 72 may be defined by a second layer 138. The intermediate wall portion 104 may be defined by a third (intermediate) layer 140.

Hence, no perforation, slots or similar elements may be provided at the initial state. Furthermore, the respective sheet metal blanks may be present in an oversized fashion (in terms of their longitudinal and/or lateral extension). This may have the advantage that, particularly with the intermediate wall portion 104, respective material removing operations may be performed so as to define for instance the guide slot 74, the wall portions 70, 72, 104 may be handled and processed with little efforts.

After an initial (rough) processing of at least some of the respective wall portions 70, 72, 104, the wall portions 70, 72, 104 may be bonded to each other. To this end, for instance laser bonding, laser welding and similar processes may be utilized. In the bonded state, further material removing processing may be performed. For instance, the teeth 38 may be processed to obtain their desired shape. In this way, a first toothed leading edge 32 and a second toothed leading edge 34 may be obtained. Furthermore, a desired outline of the stationary blade 24 may be processed so as to receive the final or close-to-final product. Therefore, again referring to the exploded view of FIG. 22, the intermediate wall portion 104 in isolation is typically not present in the fragmented state as shown in FIG. 22. As the intermediate wall portion 104 is bonded to the first wall portion 70 and the second wall portion 72, a single integrally shaped layered stack may be processed. Therefore, tooth portions 134 that remain after the respective material removing processing are shown in FIG. 22 primarily for illustrative purposes as separate entities. The embodiment of the stationary blade 24 as shown in FIG. 21 may have the advantage that the height or thickness of the wall portions 70, 72, 104 may be defined and selected independently. In other words, the respective wall portion 70, 72, 104 do not necessarily have to comprise the same thickness or height.

So as to achieve the desired tapering at the second legs 82 of the second wall portion 72, the respective cross section or profile 110 may be processed accordingly without the need or requirement to process the first legs 80 of the first wall portion 70 accordingly.

Figure 23:
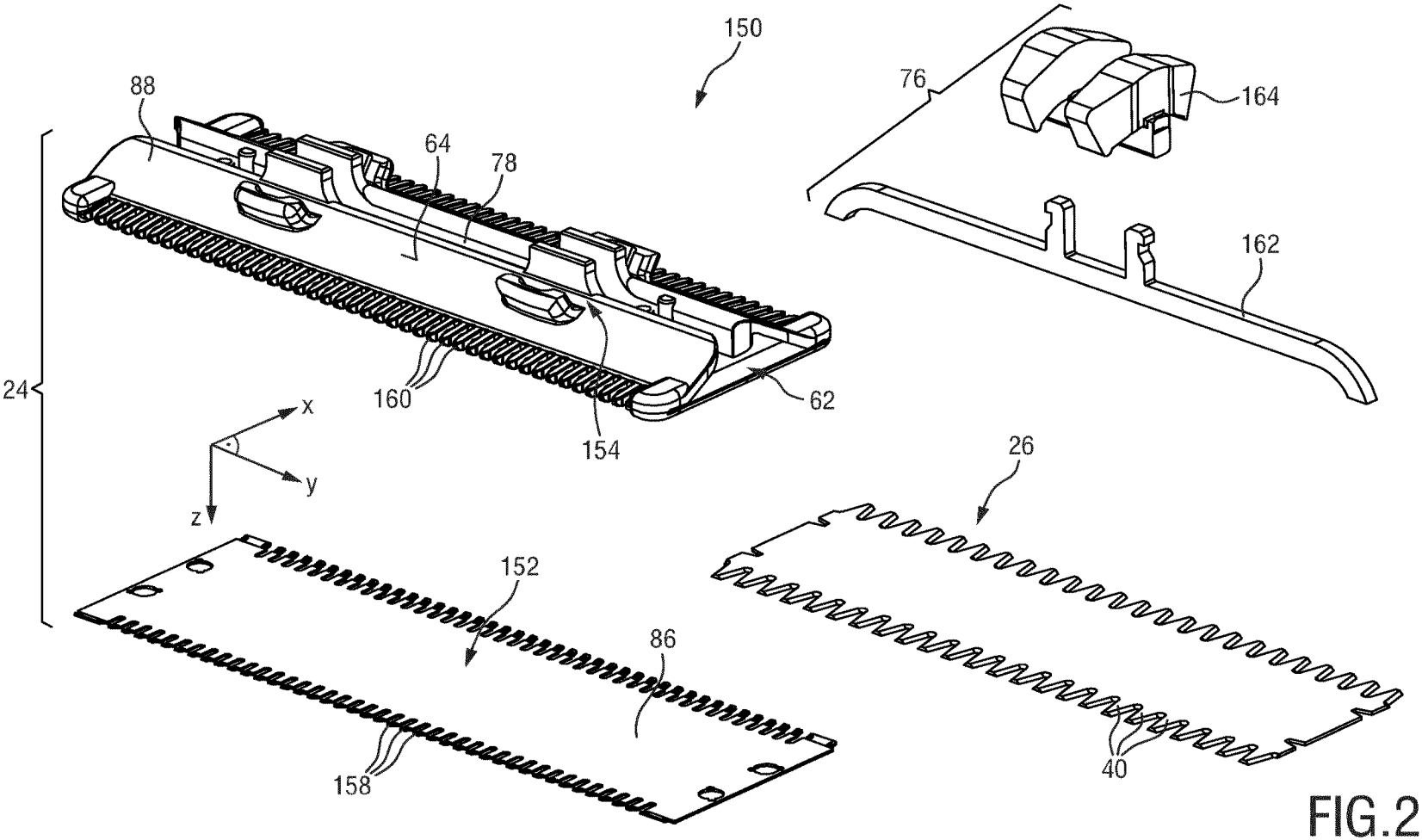
FIG. 23 is a perspective exploded bottom view of another embodiment of a blade set.

With particular reference to FIG. 23, a further embodiment of a blade set 150 is described that utilizes a stationary blade 24 that is arranged as an integrally formed metal plastic component. At least to some extent, the blade set 150 of FIG. 23 corresponds to the general design and layout of the blade set 22 illustrated in FIGS. 2 to 6. The blade set 150 is shown in FIG. 23 in a perspective exploded bottom view. Again, the state as shown in FIG. 23 thus not necessarily reflects an actual state of the respective components in the course of the manufacturing process as the stationary blade 24 is integrally formed. Hence, in practice for instance the plastic component 88 is not necessarily present in a separated state in isolation.

The metal component 86 may be also referred to as insert component 152. The plastic component 88 may be also referred to as overmolded component 154. The metal component 86 basically defines the first wall portion 70, at least a substantial portion thereof including tooth stem portions 158 that are provided with the cutting edges 120 (refer to FIG. 14). The metal component 86 may be obtained from a sheet metal blank. The sheet metal blank may be processed accordingly so as to define the tooth stem portions 158. Then, the metal component 86 may be inserted in a mold in which plastic material may be injected so as to define the plastic component 88 which may also be referred to as overmolded component 154. The plastic component 88 may define the second wall portion 72 and an intermediate wall portion 104 where the first wall portion 70 and the second wall portion 72 are interconnected at their tips. Further, the plastic component 88 may define at least a fraction of the first wall portion 70, for instance adjacent to the tips 66 of the teeth 38, refer also to FIG. 4 and to FIG. 9 in this connection. Respective overmolded tooth portions that are defined by the plastic component 88 are indicated by reference numeral 160 in FIG. 23. Furthermore, the guide arrangement 78 as already described in connection with FIG. 4 may be formed in this way.

FIG. 23 further shows an exemplary arrangement of the transmitter 76. For instance, the transmitter 76 may comprise a driving bridge 162 which may be coupled to the movable cutter blade 26, e.g. by bonding, welding or soldering. Furthermore, an engagement element 164 may be provided that may be coupled to the driving bridge 162. The engagement element 164 may be engaged by a drive shaft 50, refer also to FIG. 2 in this connection.

Further reference is made to FIGS. 24 to 27 elucidating another exemplary embodiment of a blade set 170 that utilizes a stationary blade 24 that is arranged as an integrally shaped composite metal plastic component.

Figure 24:
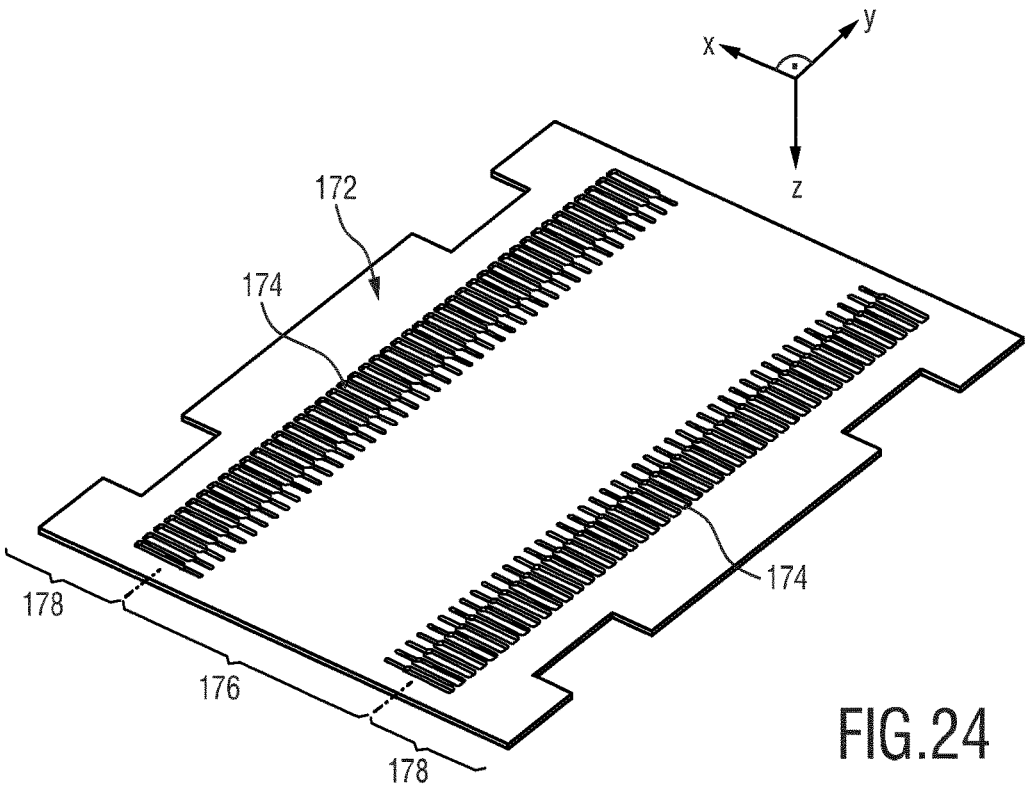
FIG. 24 is a perspective bottom view of a sheet metal component that may form part of yet another embodiment of a blade set.
Figure 25:
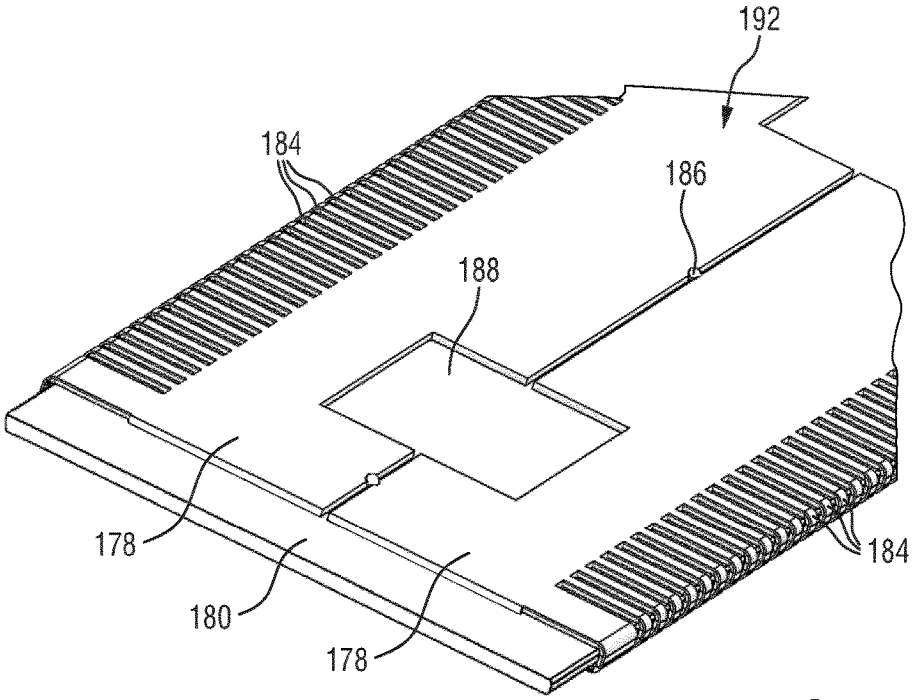
FIG. 25 is a partial perspective bottom view of the sheet metal component as shown in FIG. 24 in a bent state.
Figure 26:
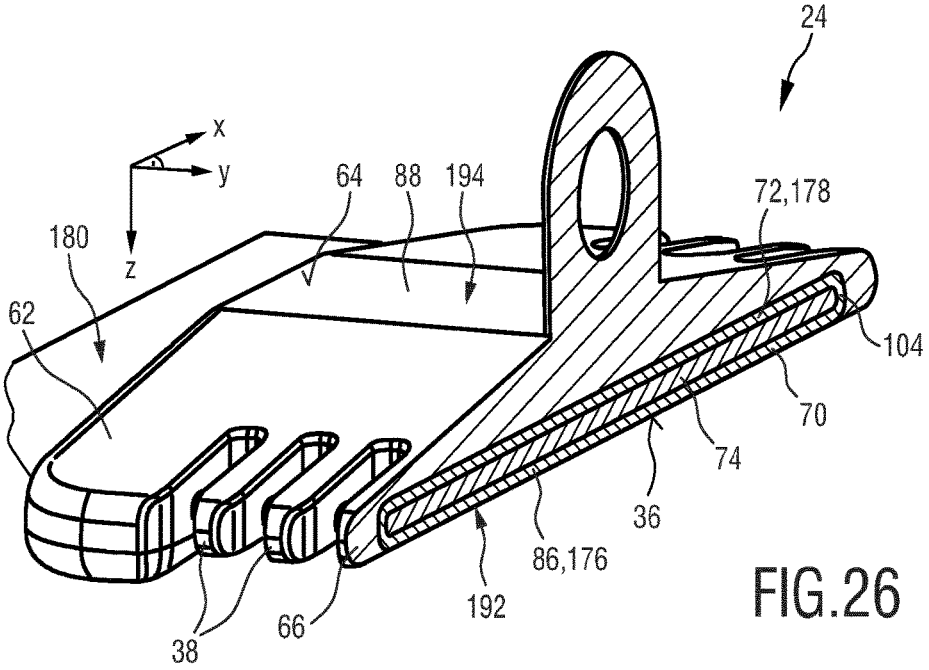
FIG. 26 is a partial perspective cross-sectional view of a stationary blade comprising a sheet metal component as shown in FIG. 25.
Figure 27:
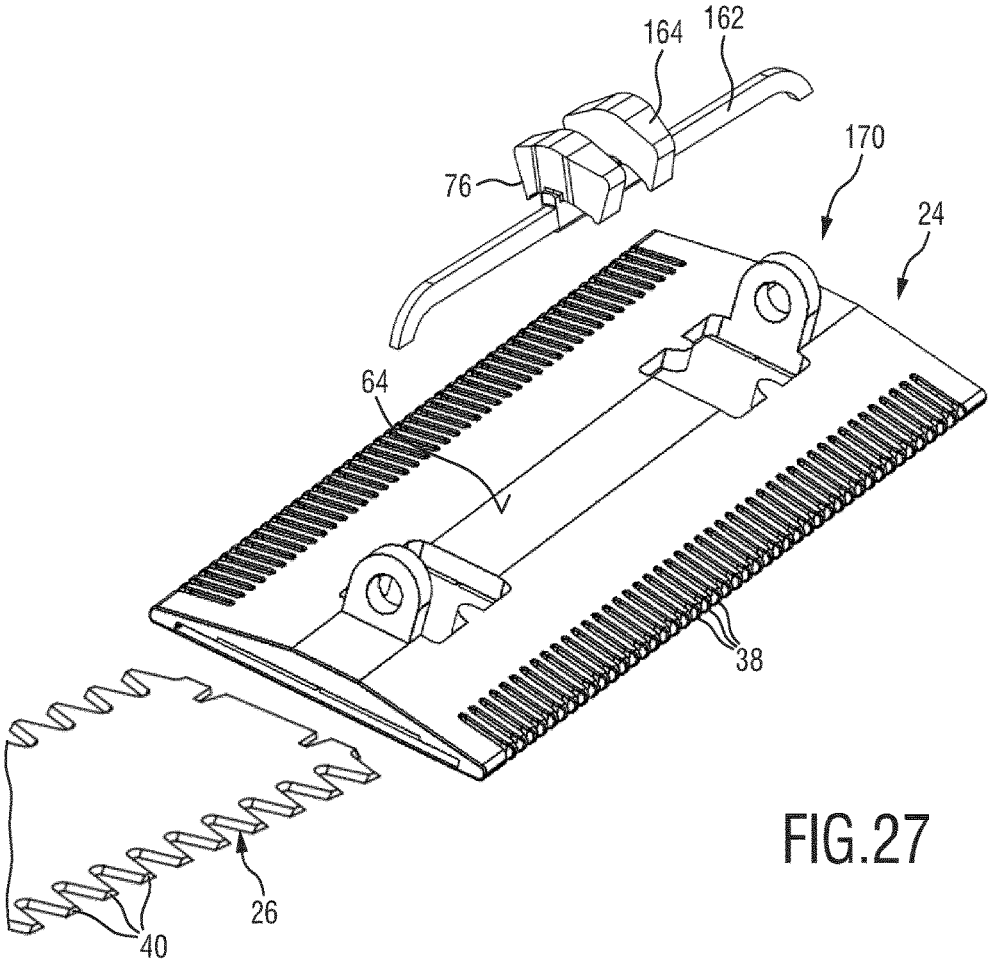
FIG. 27 is a perspective exploded bottom view of an embodiment of a blade set including a stationary blade as shown in FIG. 26.

As can be seen in FIG. 24, initially a sheet metal blank may be provided from which a metal sheet 172 may be obtained. The metal sheet 172 may be processed accordingly. For instance, respective rows of slots 174 may be processed. The metal sheet 172 may comprise a central portion 176 which defines a substantial portion of the first wall portion 70. Further, adjacent to the central portion 176, the metal sheet 172 may comprise end portions which may also be referred to as bent portions 178. The bent portions 178 are deformed, preferably bent over, so as to define an inner shell 192 of the stationary blade 24, refer also to FIG. 25. By way of example, a slot dummy 180 may be provided that occupies the space of the guide slot 74. Accordingly, a reference or gauge geometry may be provided. By bending the end portions 178 (e.g. by 180°), a closed loop or shell may be defined. Bonding spots 186 are indicated in FIG. 25. The respective end portions 178 may be bonded, particularly welded, to each other, for instance by line welding, spot welding, etc. Furthermore, actuation recesses 188 may be provided at the metal shell 192. As can be best seen from FIG. 27, the transmitter 76 may extend through the actuation recesses 188 so as to contact the movable cutter blade 26 to transmit or transfer the driving motion. The bent end portions 178 define at least a substantial portion of the second wall portion 72, refer also to FIG. 26. In the deformed state of the metal shell 192, semi-finished teeth 184 may be provided at respective toothed leading edges that comprise a basically U-shaped lateral cross section.

The metal shell 192 as indicated in FIG. 25 may be then arranged in an injection-molding mold or cavity. In this context, the slot dummy 180 or a similar dummy component may be kept in the slot 74. Then, melted plastic material may be injected so as to define the plastic component 88 which may be also referred to as overmolded component 194. Accordingly, the plastic component 88 may form a substantial portion of the second wall portion 72 and at least a fraction of the first wall portion 70. Furthermore, the metal shell 192 defines an inner core of the stationary blade 24 and therefore may form a substantial portion of the first wall portion 70 and at least a significant portion of the second wall portion 72 that delimit the guide slot 74. The metal shell 192 and the overmolded component 194 may jointly define the intermediate wall portion 104 that connects the first wall portion 70 and the second wall portion 72.

Figure 28:
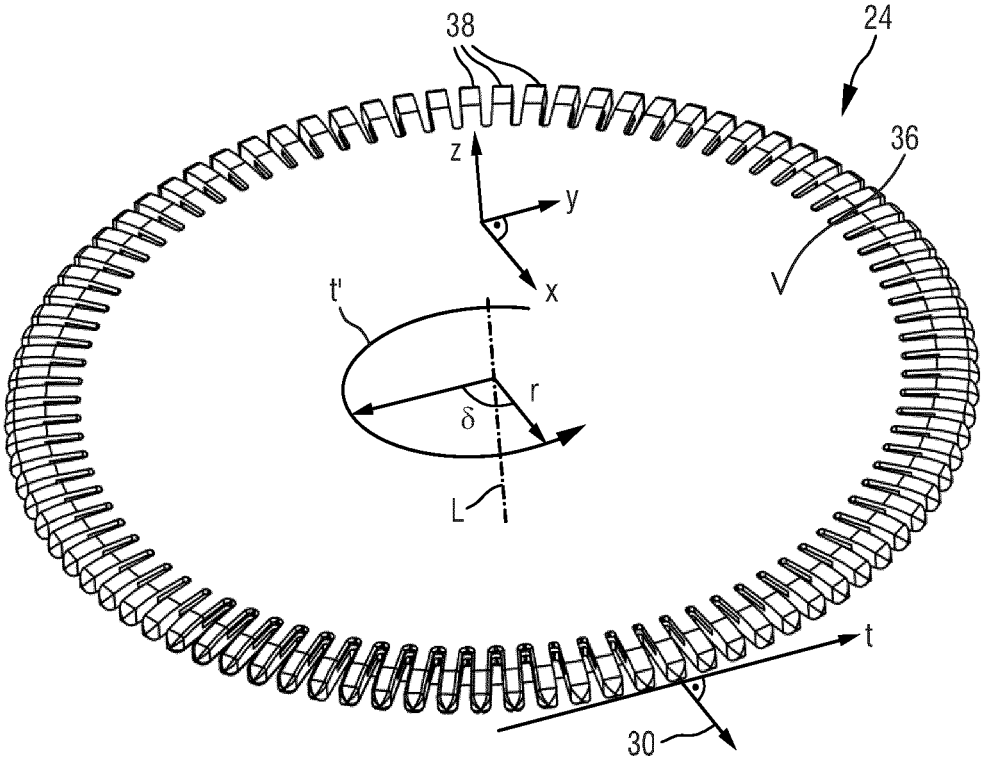
FIG. 28 is a perspective top view of a circular arrangement of a stationary blade for another embodiment of a blade set.
Figure 29:
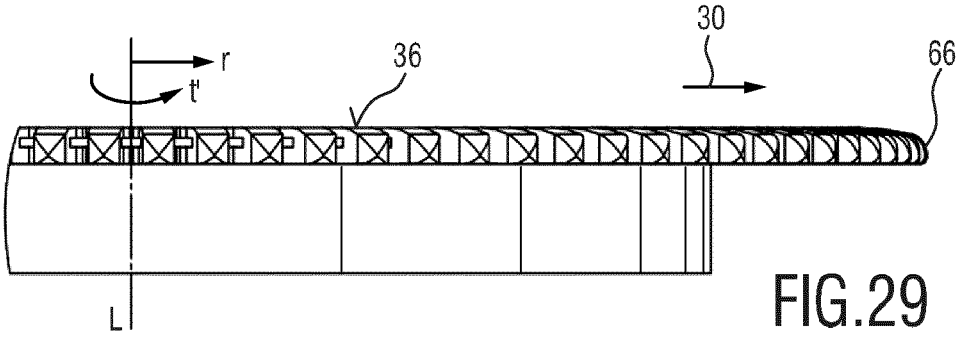
FIG. 29 is a partial side view of the stationary blade as shown in FIG. 28.
Figure 30:
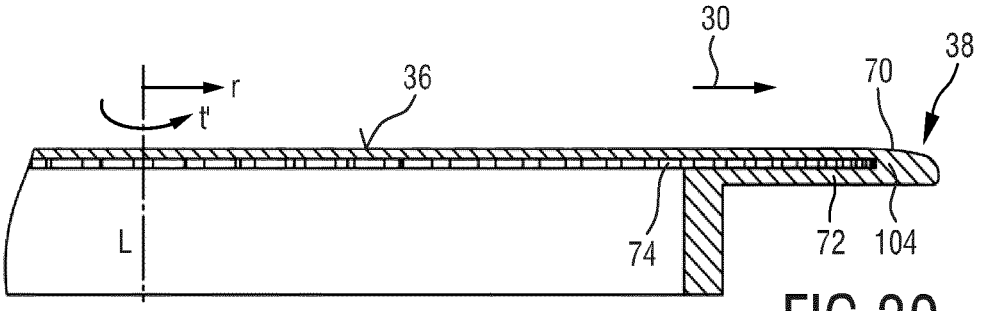
FIG. 30 is a partial cross-sectional side view of the arrangement of FIG. 29.

Further reference is made to FIGS. 28 to 30 illustrating a circular embodiment of a stationary blade 24 for a blade set 22. As already indicated, the coordinate system X-Y-Z is primarily presented for illustrative purposes. As can be best seen in FIG. 28, the circular embodiment of the stationary blade can be best described using a polar coordinate system that is having a central axis L that basically corresponds to the vertical axis or height-indicating axis Z of the (Cartesian) coordinate system X-Y-Z. The central axis L may also be regarded as a central axis of rotation. Furthermore, a radial direction or distance r originating from the central axis L is indicated in FIGS. 28, 29, and 30. In addition, a coordinate δ (delta) indicating an angular position may be provided depicting an angle between a reference radial direction and a present radial direction.

Furthermore, a tangential direction is indicated by tin FIG. 28 which is basically perpendicular to the (imaginary) moving direction 30 and to the radial direction r of a currently observed tooth. In addition, a circumferential direction t' is illustrated in FIGS. 28, 29, and 30 that indicates a circumferential and/or tangential direction. In other words, the tangential direction t is a tangent line to the circumferential direction t' at a distinct point thereof that is described by an axial angle δ.

It will be readily understood by those skilled in the art that several aspects of the present disclosure described in connection with at least one of the embodiments as described above are not limited to the particular disclosed (linear) embodiment and may be therefore readily transferred and applied to other embodiments, regardless of whether they are introduced and presented in connection with a Cartesian coordinate system or a cylindrical coordinate system. A cutting operation of a blade set 22 that implements a circular stationary blade 24 and a corresponding circular movable cutter blade 26 may be effected by a relative rotational movement between the movable cutter blade 26 (not shown in FIGS. 28 to 30) and the stationary blade 24. In other words, the respective cutting motion may be a one-directional rotational movement or an oscillating movement.

Also the stationary blade 24 defines a top surface 36 that faces the skin when in operation. Apart from that, respective teeth 38 may be provided that may be arranged at a single circular toothed leading edge. As also the circular stationary blade 24 may be arranged as a double-sided or double-walled stationary blade, a first wall portion 70 and a second wall portion 72 may be present. Between the first wall portion 70 and the second wall portion 72, an intermediate wall portion 104 may be present. Therefore, consequently, also the teeth 38 of the circular stationary blade 38 may be arranged and shaped in accordance with at least one of the (linear) embodiments as described hereinbefore. With respect to the detailed structure of the circular stationary blade 24, several options may be envisaged including a layered stack arrangement as described in FIGS. 20 to 22, an integrally molded metal plastic composite arrangement including a metal component that basically defines a major portion of the first wall portion 70 as illustrated in FIG. 23, and an integrally formed metal plastic composite arrangement including an inner metal shell that defines and surrounds the guide slot and to which a plastic component is molded as illustrated in FIGS. 24 to 27.

It is therefore worth mentioning in this connection that those skilled in the art understood that particularly a circular blade set 22 that implements a circular stationary blade 24 as shown in FIGS. 28 to 30 having a considerably large radius may be construed, for the sake of understanding, as an approximate linearly shaped blade set, particularly when only a portion or circular segment of the circular stationary blade 24 is observed. Consequently, also the Cartesian coordinate system X, Y, Z that is used herein for defining and explaining linear embodiments may be transferred and applied to the embodiment of FIGS. 28 to 30.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A blade for a blade set of a hair cutting appliance, said blade comprising:

a first wall portion arranged at a top side of the blade, the top side being an outer side of the blade to serve as a skin facing wall during use;

a second wall portion at a bottom side of the blade opposite the top side, the second wall portion being at least partially offset from the first wall portion such that the first wall portion and the second wall portion define therebetween a guide slot for receiving a movable cutter blade of the blade set; and at least one toothed leading edge jointly formed by the first wall portion and the second wall portion and including teeth, wherein at least one tooth of the teeth has a first leg defined by the first wall portion and a second leg defined by the second wall portion, and wherein the first leg has a cross section having a rectangular shape and the second leg of the at least one tooth has a cross section having a triangular shape.

2. The stationary blade as claimed in claim 1, wherein at least one of the first wall portion and the second wall portion comprises cutting edges for cooperating with corresponding cutting edges of the movable cutter blade, when in operation.

3. The blade as claimed in claim 1, comprising a first layer defining the first wall portion, a second layer defining the second wall portion and an intermediate layer arranged between the first layer and the second layer, wherein the first layer, the second layer and the intermediate layer are formed from metal material, wherein each of the first layer and the second layer is formed from a sheet metal blank, wherein the first layer and the second layer are bonded to one another via the intermediate layer thereby forming tips of the teeth, wherein the intermediate layer spaces the first layer and the second layer to define the guide slot therebetween, and wherein the intermediate layer forms a transitional intermediate wall portion at the tips of the teeth.

4. The blade as claimed in claim 1, wherein the blade is an integrally formed metal-plastic composite blade, wherein the first wall portion is at least partially made from metal sheet material, and wherein the second wall portion is at least partially made from plastic material that is molded to the metal sheet material.

5. The stationary blade as claimed in claim 1, further comprising a plastic component, wherein the triangular shape of the second leg of the at least one tooth is tapered along a direction away from the first leg in such a way that the second leg and the first leg are arranged in a non-symmetrical fashion with respect to one another, wherein the first wall portion and the second wall portion comprise an inner metal shell that is integrally made from a metal component, wherein the plastic component is molded to the metal component at a bottom side of the metal component facing away from the skin, and wherein the tapering of the second leg is at least partially formed by the plastic component.

6. A blade set for a hair cutting appliance, said blade set being arranged to be moved through hair in a moving direction to cut hair, said blade set comprising:

the blade as claimed in claim 1, and a movable cutter blade comprising at least one toothed leading edge, said movable cutter blade being movably arranged within the guide slot defined by the blade, such that, upon relative motion between the movable cutter blade and the blade, the at least one toothed leading edge of the blade cooperates with corresponding teeth of the movable cutter blade to enable cutting of hair caught therebetween in a cutting action.

7. A hair cutting appliance comprising:

a housing accommodating a motor; and the blade set as claimed in claim 6, wherein the blade is releasably attached to the housing, and wherein the movable cutter blade, in a mounted state, is operably connected to the motor, such that the motor is capable of linearly driving or rotating the movable cutter blade within in the guide slot of the blade.

8. The blade of claim 1, wherein the first and second legs are non-parallel and arranged in a non-symmetrical fashion, wherein the triangular shape of the second leg of the at least one tooth is such that the second leg is tapered extending from the bottom side to a tip of the of the second leg away from the first leg in such a way that the second leg and the first leg are arranged in the non-symmetrical fashion with respect to one another, and wherein the triangular shape of the second leg of the at least one tooth is such that the second leg is at least partially tapered towards a tip of the at least one tooth.

9. The blade of claim 1, wherein the triangular shape of the second leg is tapered such that the triangular shape extends from the bottom side to a tip of the second leg away from the first leg, and wherein the triangular shape of the second leg of the at least one tooth is such that the second leg is at least partially tapered towards a tip of the at least one tooth.

10. The stationary blade as claimed in claim 1, wherein lateral sides of the second leg of the at least one tooth are arranged at an inclination angle (γ) with respect to a vertical plane perpendicular to the first wall portion, wherein the inclination angle (γ) is from 3.0° to 30°.

11. The stationary blade as claimed in claim 1, wherein lateral sides of the second leg of the at least one tooth are arranged at an inclination angle (γ) with respect to a vertical plane perpendicular to the first wall portion, wherein the inclination angle (γ) is from 7.5° to 22.5°.

12. A stationary blade for a blade set of a hair cutting appliance, said stationary blade comprising:

a first wall portion arranged at a top side of the blade, the top side being an outer side of the blade to serve as a skin facing wall during use;

a second wall portion at a bottom side of the blade opposite the top side, the second wall portion being at least partially offset from the first wall portion such that the first wall portion and the second wall portion define therebetween a guide slot for receiving a movable cutter blade of the blade set; and at least one toothed leading edge jointly formed by the first wall portion and the second wall portion and including teeth, wherein at least one tooth of the teeth has a first leg defined by the first wall portion and a second leg defined by the second wall portion, wherein the first leg has a cross section having a rectangular shape, wherein lateral sides of the second leg of the at least one tooth are arranged at an inclination angle (γ) with respect to a vertical plane perpendicular to the first wall portion, and wherein the inclination angle (γ) is from 1.5° to 45°.

13. A blade for a blade set of a hair cutting appliance, said blade comprising:

a first wall portion arranged at a top side of the blade, the top side being an outer side of the blade to serve as a skin facing wall during use;

a second wall portion at a bottom side of the blade opposite the top side, the second wall portion being at least partially offset from the first wall portion such that the first wall portion and the second wall portion define therebetween a guide slot for receiving a movable cutter blade of the blade set; and at least one toothed leading edge jointly formed by the first wall portion and the second wall portion and including teeth, wherein at least one tooth of the teeth has a first leg defined by the first wall portion and a second leg defined by the second wall portion, wherein the first wall portion and the second wall portion are connected at a frontal end of the at least one toothed leading edge, thereby forming tips of the teeth including a tip of the at least one tooth, and wherein a cross section of the first leg at the first wall portion is rectangular, wherein the second leg is tapered in a direction away from the first leg, and wherein the first leg is larger in width than at least a bottom region of the second leg.

14. The stationary blade of claim 13, wherein a portion of the bottom region of the second leg has parallel walls.

15. A blade for a blade set of a hair cutting appliance, the blade comprising:

a first wall portion arranged at a top side of the blade, the top side being an outer side of the blade to serve as a skin facing wall during use;

a second wall portion at a bottom side of the blade opposite the top side, the second wall portion being at least partially offset from the first wall portion such that the first wall portion and the second wall portion define therebetween a guide slot for receiving a movable cutter blade of the blade set; and at least one toothed leading edge jointly formed by the first wall portion and the second wall portion and including teeth, wherein at least one tooth of the teeth has a first leg defined by the first wall portion and a second leg defined by the second wall portion, and wherein a cross section of the first leg has a rectangular shape, and a cross section of the second leg has one of a triangular shape, a trapezoid shape and a half-elliptical shape.

* * * * *